US008267421B2

(12) United States Patent
Krenn et al.

(10) Patent No.: US 8,267,421 B2
(45) Date of Patent: Sep. 18, 2012

(54) SNOWBOARD BINDING WITH A CONTROLLED INSTEP ELEMENT

(75) Inventors: Thomas Krenn, Perchtoldsdorf (AT); Andreas Janisch, Oeynhausen (AT); Roland Kittag, Pressbaum (AT)

(73) Assignee: SAM Sport and Marketing AG, Scherzingen (CH)

( * ) Notice: Subject to any disclaimer, the term of this patent is extended or adjusted under 35 U.S.C. 154(b) by 87 days.

(21) Appl. No.: 12/446,782

(22) PCT Filed: Oct. 23, 2007

(86) PCT No.: PCT/EP2007/009180

§ 371 (c)(1),
(2), (4) Date: Aug. 16, 2010

(87) PCT Pub. No.: WO2008/049576

PCT Pub. Date: May 2, 2008

(65) Prior Publication Data

US 2010/0295269 A1 Nov. 25, 2010

(30) Foreign Application Priority Data

Oct. 24, 2006 (DE) ..... 10 2006 050 703
Jan. 17, 2007 (DE) ..... 10 2007 003 339
Apr. 13, 2007 (DE) ..... 10 2007 017 888

(51) Int. Cl.
*A63C 9/04* (2006.01)

(52) U.S. Cl. ..... 280/623; 280/633; 280/619

(58) Field of Classification Search ..... 280/11.3, 280/11.15, 11.31, 11.33, DIG. 12, 14.21, 280/14.22, 611, 616–617, 619–620, 623, 280/626, 636

See application file for complete search history.

(56) References Cited

U.S. PATENT DOCUMENTS 3,258,820 A * 7/1966 Steinberg ..... 24/70 R
5,692,765 A * 12/1997 Laughlin ..... 280/619
5,918,897 A 7/1999 Hansen et al.
6,116,634 A * 9/2000 Mometti ..... 280/613
6,443,465 B1 * 9/2002 Maravetz et al. ..... 280/14.22
6,511,091 B1 * 1/2003 Su et al. ..... 280/617
6,705,633 B2 * 3/2004 Poscich ..... 280/618
6,739,615 B1 * 5/2004 Maravetz et al. ..... 280/624
6,955,362 B2 * 10/2005 Bazzi ..... 280/14.22
7,147,233 B2 12/2006 Edmond (Continued)

FOREIGN PATENT DOCUMENTS

AT 403249 B 12/1997

(Continued)

*Primary Examiner* — John Walters
*Assistant Examiner* — James Triggs
(74) *Attorney, Agent, or Firm* — Millen, White, Zelano & Branigan, P.C.

(57) ABSTRACT

The invention relates to a snowboard binding with a sole-plate which is to be fastened on the surface of a snowboard and to which, firstly, an instep element is fastened or coupled, which instep element can be adjusted between a clamping position and a release position and by means of which the upper side of a shoe, which can be accommodated in the snowboard binding can be partially embraced, and to which, secondly, a leg support is pivotably coupled, which leg support can be pivoted between a rear entry position and a front travelling position with control means provided by means of which a pivoting movement of the leg support into the entry position is coupled at least in some sections to an adjustment movement of the instep element from the clamping position into the release position.

24 Claims, 20 Drawing Sheets

U.S. PATENT DOCUMENTS

Figure 1:
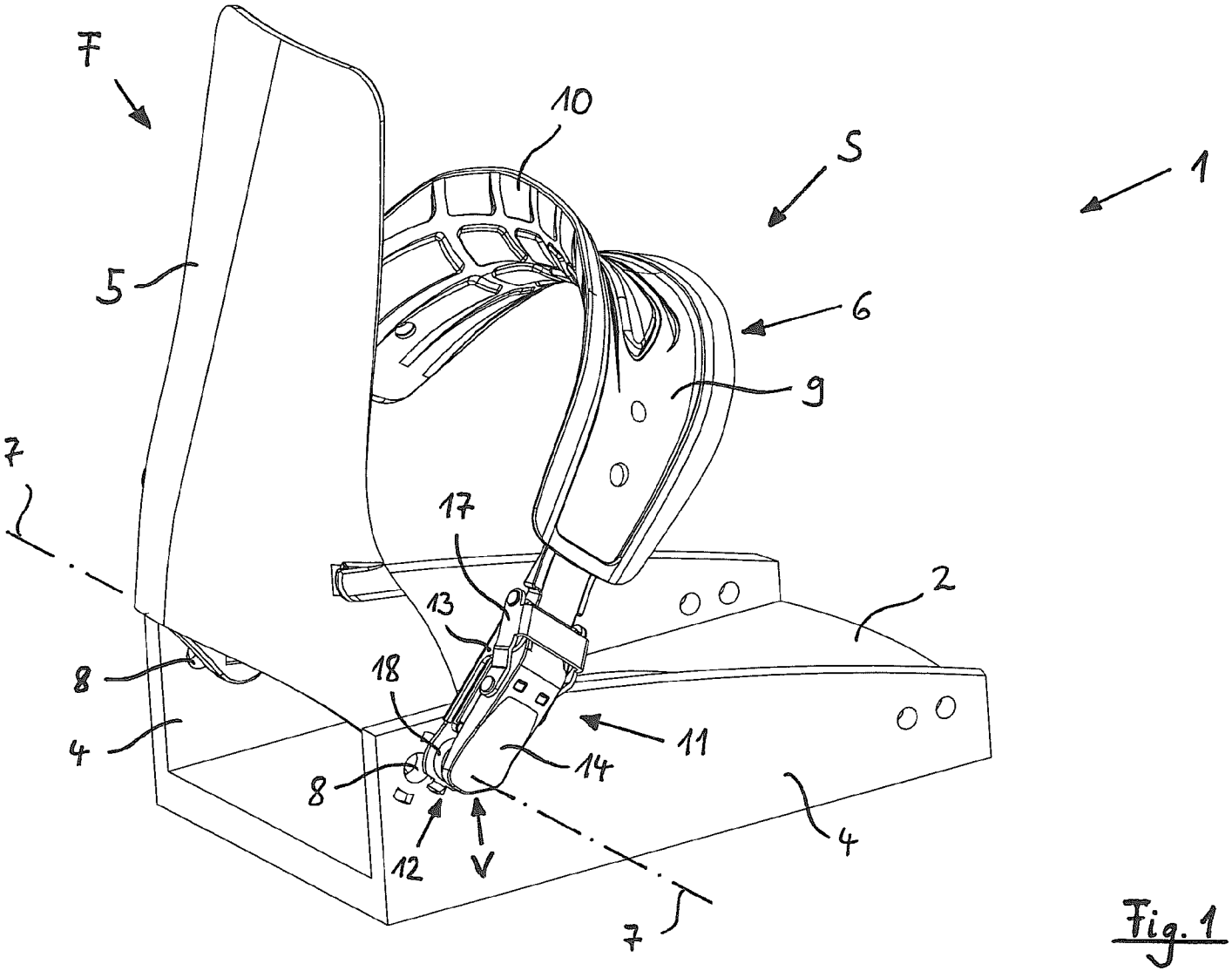

| | | | | |
|---|---|---|---|---|
| 7,207,592 | B2 * | 4/2007 | Pascal et al. | 280/623 |
| 7,568,719 | B2 * | 8/2009 | Sauter | 280/619 |
| 7,669,880 | B2 * | 3/2010 | Doyle et al. | 280/611 |
| 7,699,678 | B2 * | 4/2010 | Cannon | 441/70 |
| 7,766,364 | B2 * | 8/2010 | Cunningham et al. | 280/623 |
| 2004/0227328 | A1 | 11/2004 | Carrasca | |
| 2004/0262887 | A1 | 12/2004 | Bianchi | |
| 2006/0027981 | A1 | 2/2006 | Pascal et al. | |

FOREIGN PATENT DOCUMENTS

| | | | |
|---|---|---|---|
| AT | 403249 | W | 12/1997 |
| DE | 4435113 | C1 | 5/1996 |
| EP | 0824942 | A | 2/1998 |
| EP | 0890376 | A | 1/1999 |
| EP | 0890376 | W | 1/1999 |
| EP | 1611929 | A1 | 1/2006 |
| WO | 2008049576 | R | 2/2008 |

* cited by examiner

L
6
14
9
17
O
24
23
H
16
19
18
13
B-B 6
14
9
17
13
22
18
A-A
B
A
6
9
17
21
21
16
13
18
B
A

B-B

A-A

A
B
6
9
13
14
16
17
18

B-B
A-A
V
H
6
9
17
22
14
16
13
18
A
B

B-B

A-A

A
B
6
9
12
14
16
18
13

SNOWBOARD BINDING WITH A CONTROLLED INSTEP ELEMENT

This invention relates to a snowboard binding according to preamble of Claim 1. It serves to fix a snowboard boot on a snowboard and comprises a sole-plate, which can be fastened on the surface of a snowboard. A leg support is pivotably coupled to the sole-plate, which can be pivoted between a rear entry position and a front travelling position. An instep element is also fastened to the sole-plate or preferably pivotably coupled with it and which can be adjusted between a clamping position and a release position and which can partially embrace the upper side of a boot, which can be accommodated in the snowboard binding in the clamping position such that the boot is secured against the sole-plate and/or against the leg support. Control means are also provided, by means of which pivoting of the leg support into the entry position is coupled at least in some sections to an adjustment movement of the instep element from the clamping position, by means of which the instep element is adjusted from the clamping position into the release position.

Such bindings are also referred to as "soft boot bindings" or "shell boot bindings" as they are designed to be used with relatively soft snowboard boots and have a high degree of flexibility that is e.g. desired by "freestyle boarders". In this respect, the sole-plate is either directly or indirectly fastened on the surface of a snowboard with a hold-down device to be screw mounted in a round opening. Thereby, the instep element is usually pivoted at walls extending up along on the sides of the sole-plate, which are referred to as side walls.

The instep element usually comprises a tension belt also referred to as a "strap", which embraces the front foot and instep, thereby being able to push the snowboard boot down against the sole-plate and/or back against the leg support.

The typical leg support for such snowboard bindings, which is also referred to as a "highback" or "heckspoiler" serves to hold the back side of the snowboard boot and/or the fibula of the snowboarder to the back. For this, the leg support is pivotably fastened to the side walls about an axis aligned at a right angle to the longitudinal axis of the sole-plate in order to set a certain angle of incline that defines the so-called frontal inclination position of a snowboarder's lower leg. The angle of incline of the leg support can be adjusted to the riding position desired by the boarder in this respect. Thereby, designing the leg support in two parts with an adjustable upper padded part opposite a bottom support part is also known.

The pivotability also allows the leg support, which normally is elevated approximately 20 to 30 cm from the snowboard surface, to be folded forward toward the strap and/or the surface of the snowboard so that it is less cumbersome when transporting and storing the snowboard.

It is also known that the leg support can be maneuvered indirectly along the side walls of the sole-plate by means of a heel clamp extending to the back. Such a heel clamp that is also referred to as a "heelcup" embraces the back sole area of the snowboard boot and/or the heel of a snowboarder. The heel clamp is connected either rigidly or pivotably with the sole-plate of the snowboard binding.

As such snowboard bindings are conventionally only opened and closed with the straps, clamping into such bindings is relatively cumbersome. To simplify the clamping in and releasing process, it is proposed in DE 44 35 113 C1 to guide the leg support such that it can be pivoted back into a folded down entry position, with which a snowboard boot can be inserted in the snowboard binding from the back when the strap is fastened. After the snowboard boot is placed against the instep element, the leg support is folded up until it has assumed a predefined closed position corresponding to a travelling position. By folding up the leg support, the snowboard boot is simultaneously pushed further to the front against the instep element such that the desired tension force is also created as a result. In this travelling position, the leg support is fastened by a suitable locking mechanism. To release the snowboard binding, the locking mechanism is released such that the leg support can be folded back into the open position and/or entry position and the boot can be taken out of the binding.

Although the possibility of so-called heck entry created in this way enables coupling and decoupling without the cumbersome closing and/or opening of the instep element, thereby facilitating the process somewhat, an increased level of convenience is desired particularly when entering into the binding. With the binding according to DE 44 35 113 C1, this occurs while the instep element is fastened, which at least considerably complicates the last part of inserting the boot due to the frictional forces that are created at this point.

Furthermore, snowboard bindings of the type initially mentioned were suggested, which are known e.g. from the patent US 2004/0262887 A1. Control means are provided with such snowboard bindings, which, when folding down the leg support into the entry position by means of an upward movement of the instep element whose length is unchanged, automatically create an enlargement of the space available for the snowboard boot. For this, the entire strap of the instep element is pivotably coupled to the sole-plate of the snowboard binding via an intermediate lever.

The disadvantage of such a binding, however, is that in order to enlarge the available space, a very elaborate lever mechanism is necessary, with which another connecting lever is required in addition to the aforementioned intermediate lever, which transfers the pivoting movement of the leg support to the intermediate lever and therefore to the instep element. Such an elaborate lever mechanism is also required on both sides of the binding, thereby not only resulting in a corresponding increase in the weight of the binding, but particularly in increased manufacturing costs.

The binding as per US 2004/0262887 A1 also has the considerable disadvantage in that closing the leg support requires, at least at the last part, considerable force as the instep element securely coupled to the leg support by means of the lever mechanism simultaneously moves down at the same time, thereby being exposed to considerable counterpressure applied by the boot inserted in the binding.

The task of this invention is therefore to create a structurally simple snowboard binding of the aforementioned kind that can be affordably manufactured, which also provides for convenient entry and release with a low weight and with which folding up the leg support into the travelling position is particularly easy when the boot has been inserted in the binding.

This task is solved with the present invention by means of a snowboard binding as per Claim 1. Advantageous designs and arrangements of the invention are provided in the dependent claims.

With the inventive solution, it is essential that the control means are designed such that when pivoting the leg support back to the entry position, the adjustment movement of the instep element is greater than the adjustment movement of the instep element created when pivoting the leg support up to the travelling position. When folding up the leg support into the travelling position, the instep element therefore moves back no more than part of the way travelled with the adjustment movement that took place when opening the binding.

A significant advantage of the unequal coupling with the adjustment movement of the instep element for pivoting the leg support to the back and front is up to that folding up the leg support can be easily performed with only a small amount of effort along the entire pivoting section as counter-pressure exerted on the instep element by a boot inserted in the binding exists, if at all, only to a much lesser degree.

The boot can therefore be first inserted in the opened binding without any complication. After which, the leg support can be folded up into the travelling position in order to close the binding effortlessly in an initial closing step. Thereby, this first closing step serves to position the boot in the binding. Such positioning can in particular be performed against a toe element that can be provided in the front section of the binding and which is able to hold the front part of the boot forward and preferably also able to hold it such that the boot can then be fastened in its longitudinal direction relative to the binding between the leg support and the toe element. In a second closing step in order to completely close the binding, the remainder of the adjustment movement of the instep element is then performed manually. The effort required to clamp in the boot can easily be applied thereby. Through the inventive division of the closing step into two partial steps, it also becomes possible with so-called heck entry bindings to apply the tension force required to securely hold the inserted boot. So far, this was only possible with conventional soft bindings with various clasps or buckles on the instep element, but not with more convenient heck entry bindings. The present invention therefore combines for the first time the advantage of optimum binding performance and/or good performance with the advantage of high convenience when releasing from and/or entering into the binding, which so far could not exist together.

Another significant advantage is up to that by means of the inventive coupling, which is no more than partial, to the adjustment movement of the instep element when folding up the leg support into the travelling position, the control means can be designed so that such coupling is achieved in a considerably more simplified manner. In particular, this eliminates the necessity for additional intermediate and connecting levers. As a result, the inventive snowboard binding has a lower weight and above all, can be manufactured in a particularly cost-effective manner.

The leg support folded up into the travelling position can be fastened in this position with the locking mechanism. A suitable locking mechanism can e.g. be formed by means of straps or cable pulls held by the leg support or form-fit locking bolts or fasteners. Preferably, the locking mechanism comprises a cable pull fastened in a known manner on both sides of the middle or front area of the sole-plate, which encircles the back of the leg support and can be tightened there by means of a locking lever pivotably mounted on the back of the leg support in order to lock the leg support in place.

It is particularly advantageous if the control means are designed such that they result in coupling with the adjustment movement of the instep element only when pivoting the leg support back to the entry position while coupling with an adjustment movement of the instep element does not occur when pivoting the leg support into the travelling position. The fact that pivoting the leg support to the front does not result in any adjustment of the instep element results in the greatest possible simplification of the closing step and/or a maximum reduction of the effort required for folding up the leg support.

In order to conveniently design entry into the binding and release from the binding, it is suggested that the adjustment movement of the instep element comprises a pivoting movement and/or an opening movement, which opens the instep element or expands its area and/or length.

Furthermore, it is particularly advantageous if the instep element comprises at least one buckle, which is manipulated by the control means such that it results in opening or expanding the instep element when pivoting the leg support back to the entry position. In this manner, the control means are not required on both sides of the binding, but only one for each instep element on the buckle. This considerably reduces the weight and above all, the manufacturing costs of the inventive binding.

According to a particularly preferred form of implementation for the invention, it is suggested that the control means comprise at least one actuating cam, which is rotationally connected to the leg support. The actuating cam acts, at least in some sections, either directly or indirectly together with a mobile element on the buckle of the instep element. This interaction can occur advantageously by means of being allocated next to one another or through the intervention of a coupling link. This produces a very structurally small and compact, but at the same time particularly stable and robust form of implementation for the control means.

For this, it is particularly advantageous if the instep element comprises a buckle coupled, preferably pivotably, to the sole-plate with a buckle base and a clamping lever allocated pivotably on it and a strap coupled to the clamping lever directly or via a pinion. A control slider that can be slid length-wise is routed in the buckle base, which acts together with the actuating cam. This produces a very compact and structurally small form of implementation.

In order to constantly maintain a defined position of the control slider, it is advantageous if a spring element is provided that spring loads the actuating cam toward the control slider. Preferably, the spring element even pushes or pulls the control slider up to the actuating cam so that both parts are constantly adjacent to one another.

According to another particularly preferred form of implementation for the invention, it is designated that the control slider comprises at least a retaining lug, which when the buckle is closed, is in a retaining position of the control slider, with which the instep element is located in the clamping position and embraces form-fit a lug or edge of the clamping lever and holds the clamping lever in a closed position. The form-fit embrace and/or hold of the clamping lever can be released by means of pushing the control slider to a release position. The edges that can be embraced by a retaining lug can be preferably configured in duplicate e.g. on the bottom of the clamping lever pointing toward the boot. A particularly stable construction can be achieved by means of a central retaining lug, which is able to pass through an opening of the clamping lever, which is situated accordingly in the middle, and is able to embrace the upper edge of a side wall adjacent to the opening.

In this respect, it is particularly advantageous if the control slider can be slid into the release position by means of the actuating cam when pivoting the leg support to the back entry position. The sliding required in order to release the clamping lever can preferably also occur, independent of the sliding that automatically occurs when folding back the leg support, manually such that it is also possible to open the binding buckle without folding back the leg support which is particularly advantageous when e.g. riding on a lift. For this, the control slider is preferably pushed into the retaining position by means of the spring element. Releasing the form-fit embrace can be achieved by means of sliding the control slider up against the spring element.

When the control slider is in the release position, the buckle can advantageously be opened by itself due to the compressive forces a boot fastened in the binding exerts on the instep element. Depending on the shape and size of a boot inserted in the binding, scenarios are also possible, in which the clamping lever is located in an over-center position such that independent opening of the buckle and/or the release of the control slider released by the clamping lever does not regularly occur as a result of the compressive forces exerted by the boot. In order to also be able to ensure reliable release of the released clamping lever and/or opening of the buckle, it is preferably suggested that the control slider has-form-fit lead-out means, e.g. one or more lead-out ramps and/or lead-out curves, which are able to act together with the clamping lever and/or with part of the instep element, e.g. together with a strap, such that the clamping lever for opening the buckle is led out of its closed position and past the center point to the outside, thereby opening the buckle and the instep element is released from its clamping position when the control slider is pushed toward its release position. For this, the forced guidance of the clamping lever occurs both if brought about by the actuating cam and by means of manual sliding of the control slider.

In addition or as an alternative, the clamping lever of the buckle can also be pushed into an open position by means of a spring element. As soon as the clamping lever is released by sliding the control slider, the spring element triggers the reliable release of the clamping lever, even if it is in an over-center position.

It is furthermore particularly advantageous if the control slider features form-fit run-in means, e.g. one or more run-in bevels and/or run-in curves, which act together when closing the buckle with part of the clamping lever such that the control slider can be slid against the spring element at least until reaching its release position. When closing the buckle further, the spring-loaded control slider returns to the retaining position such that the retaining lug holds the clamping lever form-fit in its closed position. As a result, the second closing step can be performed with particular ease by simply pushing down the clamping lever.

It is furthermore particularly advantageous if the pivoting axis of the instep element is identical to the pivoting axis of the leg support. As a result when changing the position of the leg support in order to adjust the size of the binding to accommodate a larger or smaller boot shape, an adjustment of the instep element is also automatically enabled such that a separate adjustment of the instep element is not necessary. Another significant advantage is up to that, by means of the suggested allocation of the pivoting axes of the leg support and instep element, the control means for coupling the control movements, that is the pivoting movement and/or adjustment movements, can be performed with considerably more ease on a shared pivoting axis. In particular, this eliminates the need for additional intermediate levers and connecting levers such that the inventive snowboard binding can be manufactured with a particularly simple, compact, weight efficient and cost-efficient design.

Furthermore, it is particularly advantageous if the shared pivoting axis of the instep element and the leg support is allocated on the sole-plate such that it can be adjusted along the length of the sole-plate. In this manner, an adjustment of the snowboard binding to different boot sizes can be performed with particular ease and without any complication. Thereby, the longitudinal direction of the sole-plate corresponds to the longitudinal direction of a boot that can be fastened in the snowboard binding. Multiple drill holes can be advantageously made in the side walls and staggered along the longitudinal direction of the binding, in which the axes of the leg support and the instep element can be inserted as chosen.

A further beneficial design of the control means can provide that the control means can also comprise other suitable control elements in addition or in place of a control slider and actuating cam. As such, the control means can comprise one or more levers and/or pushing and/or pulling means, in particular cable pulls. Gears can also be used, particularly pinion gears can be used in order to achieve the desired control movements.

According to another particularly preferred form of implementation for the invention it is designated that the control means comprises at least one actuating cam, which is rotationally connected to one of the two elements instep element or leg support. Whereupon the actuating cam acts together with a control curve, which is rotationally connected with one of the two elements leg support or instep element such that a pivoting movement of the leg support is also coupled, at least in sections, to a pivoting movement of the instep element. The instep element can then preferably be also pivoted up into a release position when opening the binding from its clamping position in order to design the release and enter into the snowboard binding to be even more convenient. Thereby, the actuating cam is preferably rotationally connected with the leg support and the control curve is rotationally connected with the instep element. However, reverse allocation is generally also possible.

Thereby, it is particularly advantageous if the control curve is designed within a control ring, which encircles the actuating cam and which is rotationally inserted in a recess allocated in one of the other elements, leg support or instep element. Thereby, the control ring can be connected form-fit with the recess.

It is furthermore particularly advantageous if the control curve comprises at least a free-movement area limited by two stops. The actuating cam can be freely pivoted across the free-movement area between the two stops relative to the control curve. In this manner, coupling of the pivoting movement of the leg support in sections with the pivoting movement of the instep element is achieved. Coupling only occurs if the actuating cam is up against one of the two stops. Preferably, the two stops are designed as end stops.

Based on another particularly preferable form of implementation for the invention, it is designed that the control curve can be elastically deformed in the vicinity of a stop and/or in a transport area adjacent to the free-movement area. The transport area, which is preferably separate from the free-movement area by means of a stop, can then preferably come into contact with the actuating cam when the leg support is pivoted down onto the surface of the snowboard into the space-saving transport position. Thereby, though the actuating cam first experiences a certain amount of resistance when it reaches the stop, which can, however, be overcome through the elastic design of the control curve when the leg support is folded more to the front.

In designing the control curve within a control ring, it is particularly advantageous if the control ring is made of an elastic material at least in the transport area, whereupon at least in sections of the transport area, radial clearance is provided between the control ring and the wall of the recess carrying the control ring. The elastic material can be made of harder rubber such that it forms a transport area that yields to a certain extent. By means of the radial clearance, the actuating cam is able to push the control curve in the transport area to the outside and then continue to move with a slight amount of increased resistance without destroying the control curve when the leg support is folded all the way down. It is particularly advantageous if the entire control ring is made of an elastically flexible material, at least in the radial direction.

Furthermore, it is particularly advantageous if the buckle provided in the instep element can at least be unhinged in an intermediate position such that the instep element is separated into two partial elements that can be separated from one another and which are fastened or coupled to the sole-plate with a section removed from the buckle. The leg support can then be folded down even more to the front through the two partial elements of the instep element and up to the sole-plate of the binding. This makes for a particularly space-saving transport position, which is also a considerable advantage when storing a snowboard equipped with the inventive binding, in particular in the rental sector.

A subject matter of the present invention is also a snowboard, which is equipped with two bindings of the type described above.

Figure 2:
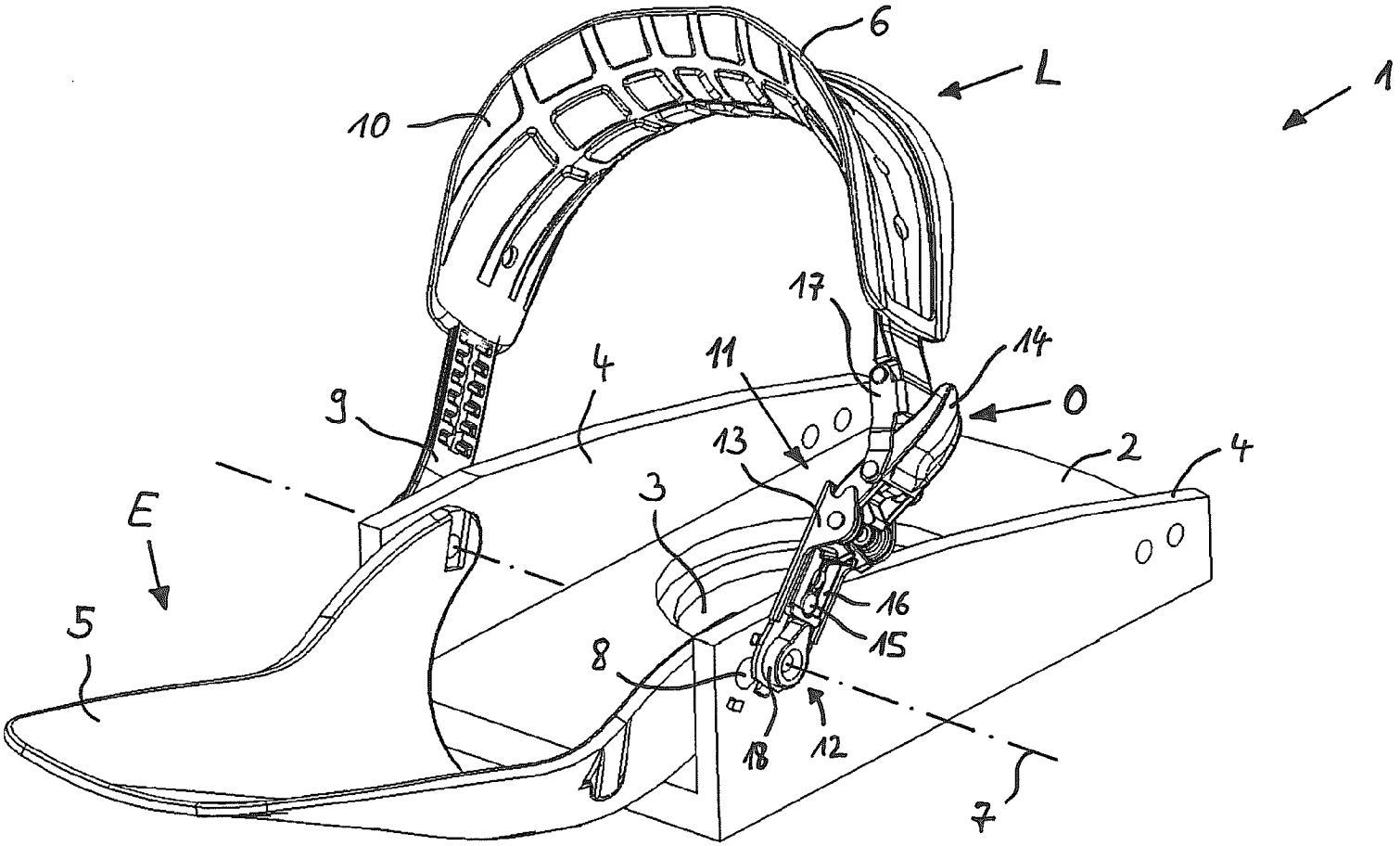
Figure 3:
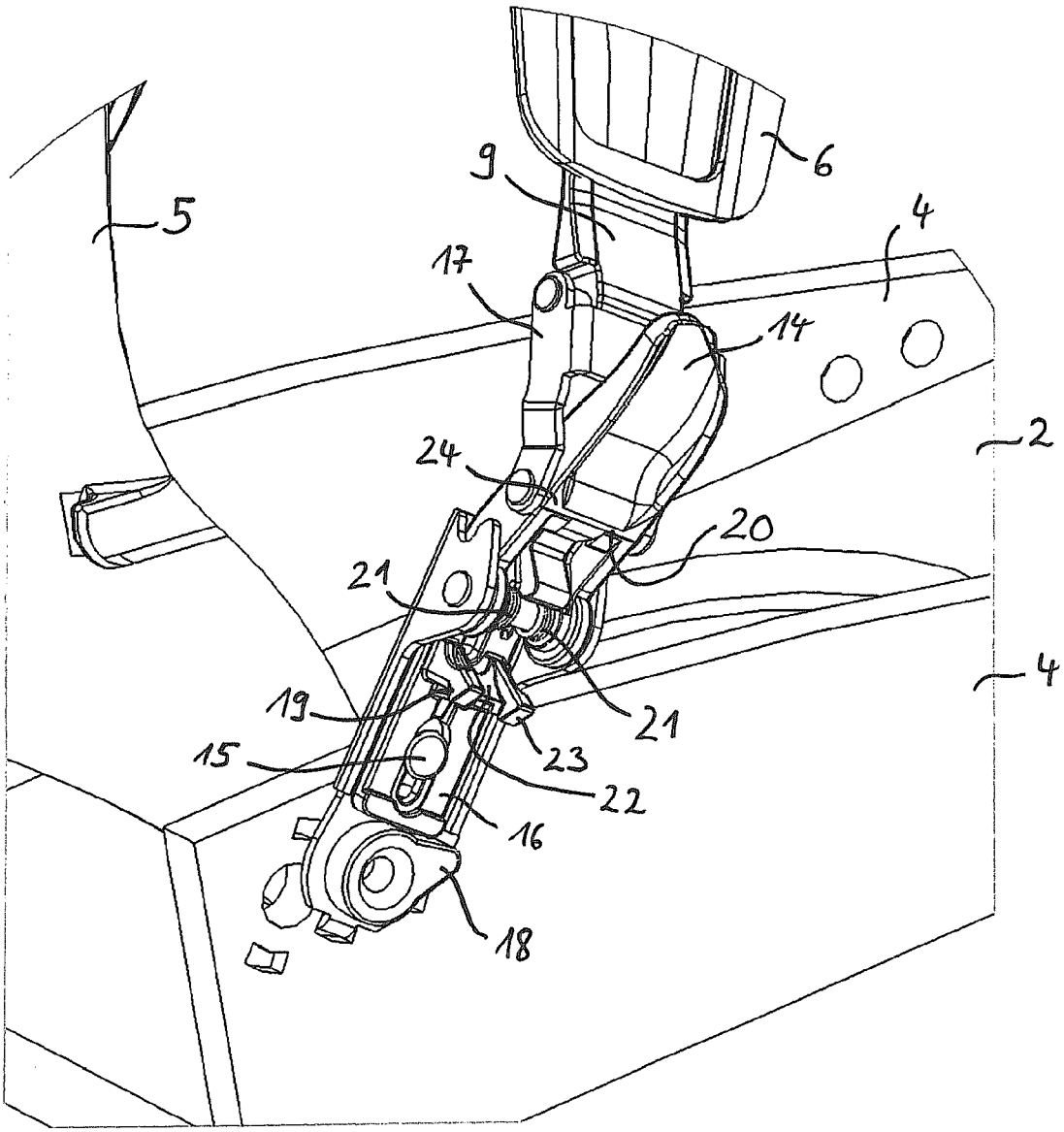
Figure 4:
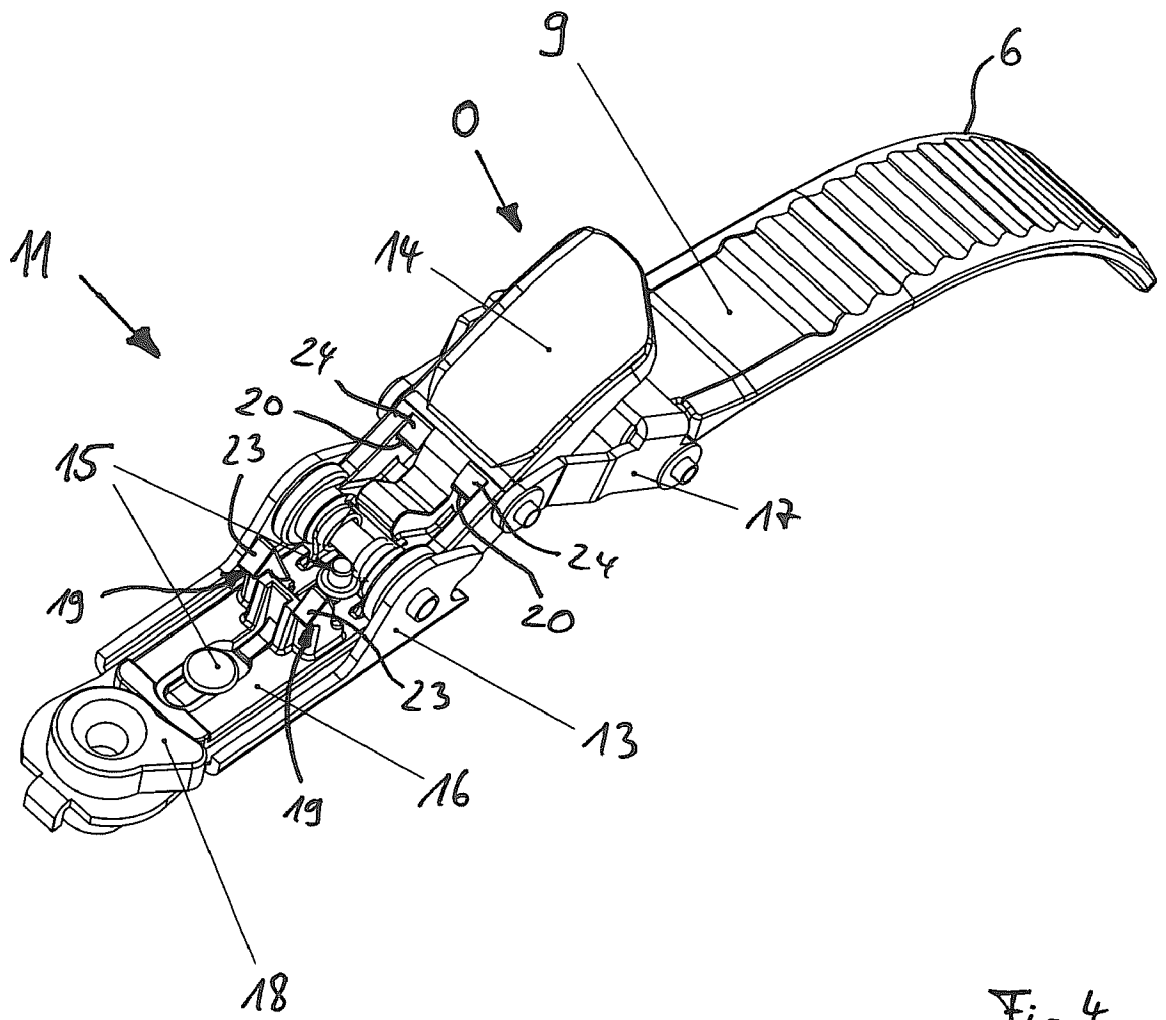
Figures 5, 5A, 5B:
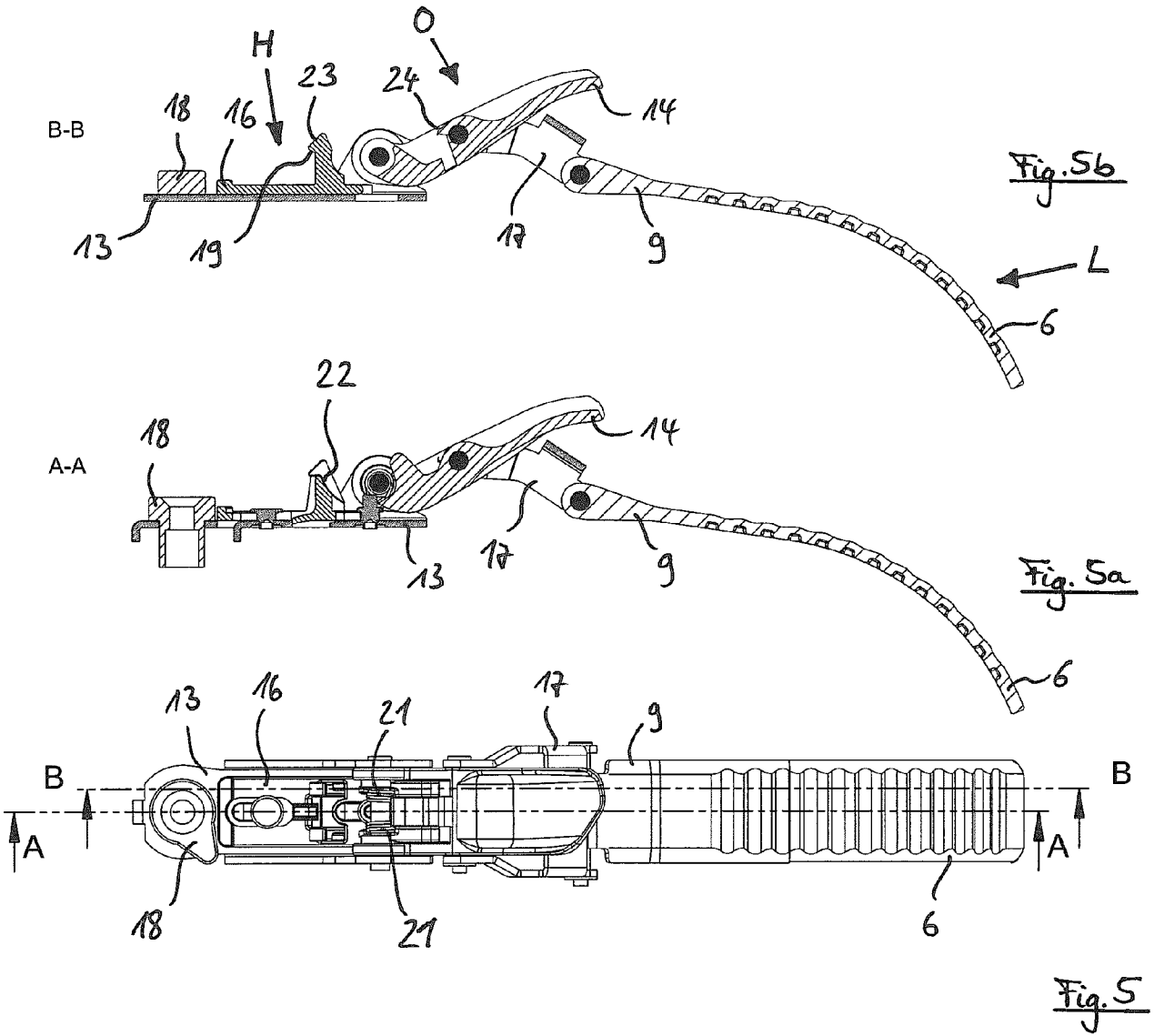
Figures 6, 6A, 6B:
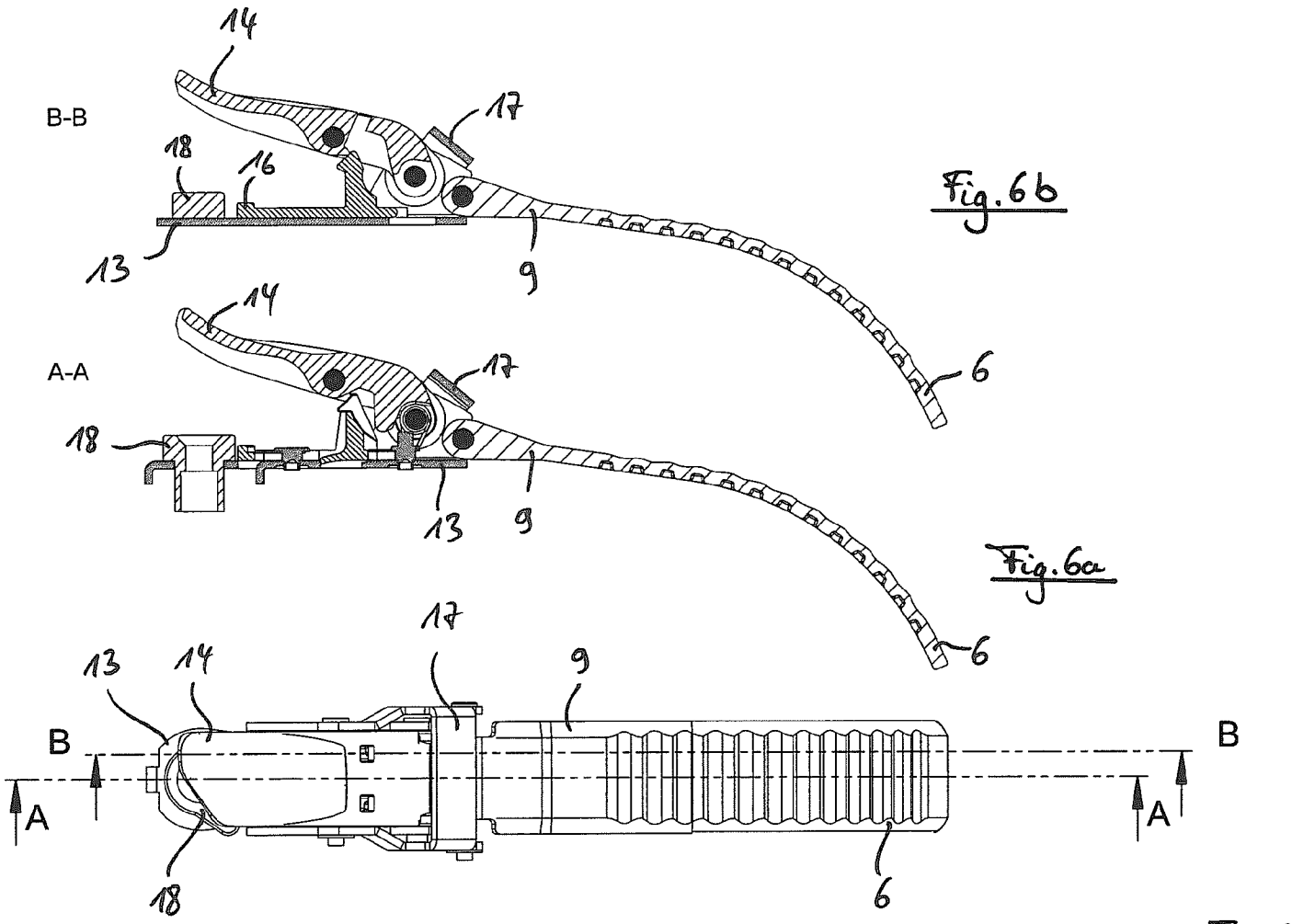
Figure 11:
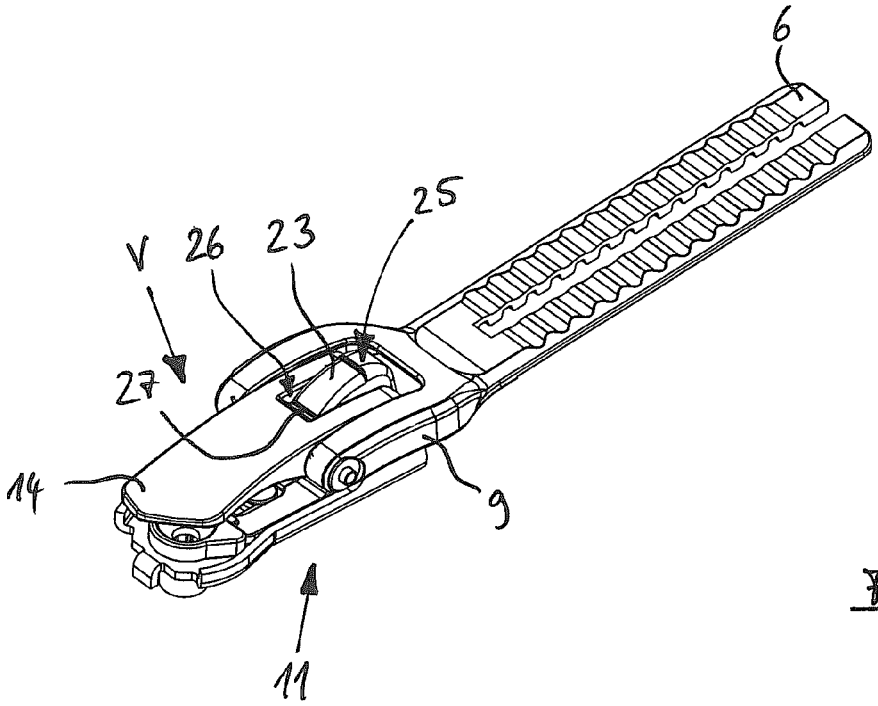
Figure 12B:
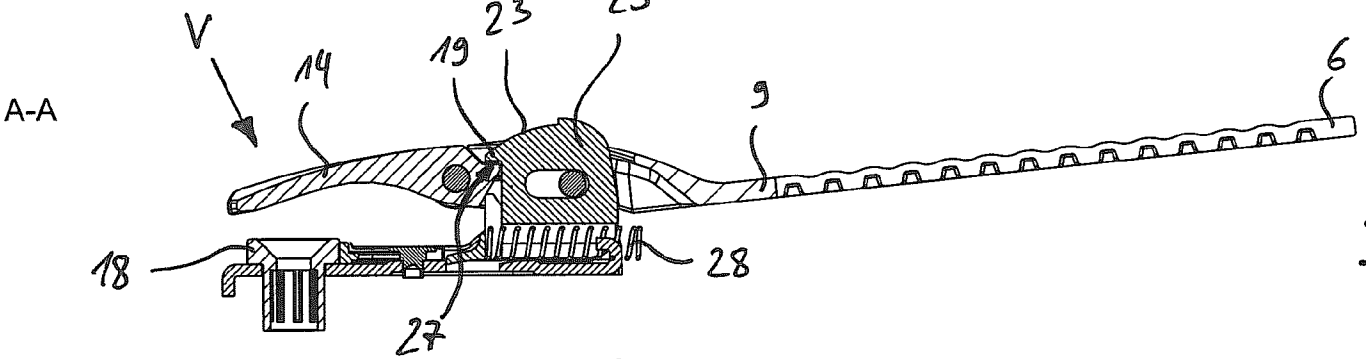
Figure 12A:
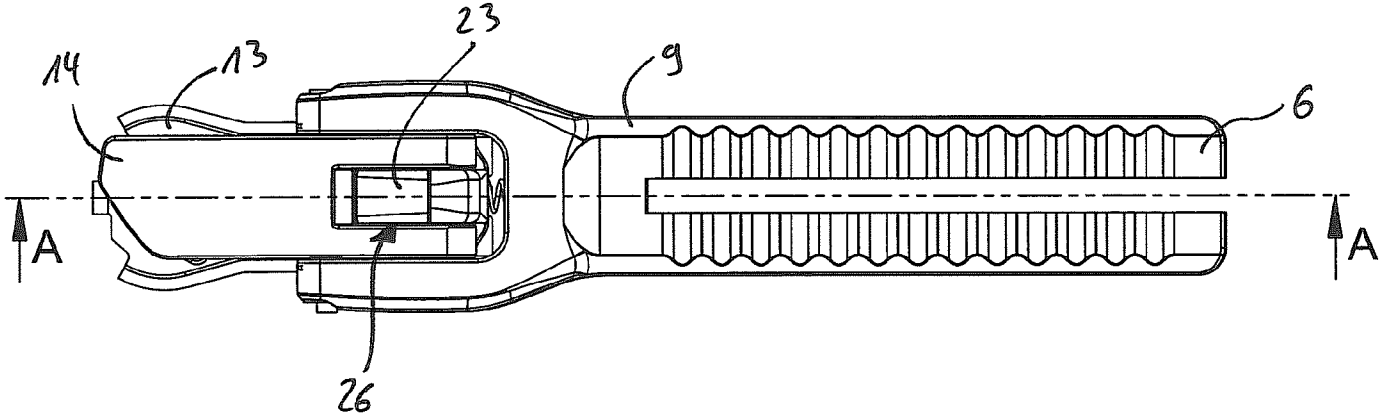

Further advantages and characteristics of the invention are provided in the following description and the examples for implementation shown in the diagrams. The following are shown:

FIG. 1: View of a snowboard binding according to the invention in a closed state;

FIG. 2: View of the snowboard binding from FIG. 1 in an opened state;

FIG. 3: Enlarged partial view of the snowboard binding from FIG. 2;

FIG. 4: Enlarged view of the buckle from FIG. 1;

FIGS. 5 to 7*b*: Top view and two different section views each of the buckle along the intersection lines A-A and B-B while closing the buckle with the leg support folded up into the travelling position;

FIGS. 8 to 10*b*: Top view and two different sectional views of the buckle each along the intersection lines A-A and B-B while folding down the leg support from the travelling position to the entry position and the associated opening of the buckle;

FIG. 11: three-dimensional view of an alternative form of implementation of a buckle in a closed state;

FIG. 12*a*: Top view of the buckle from FIG. 11;

FIG. 12*b*: Sectional view of the buckle along the intersection line A-A from FIG. 12*a;*

Figure 13:
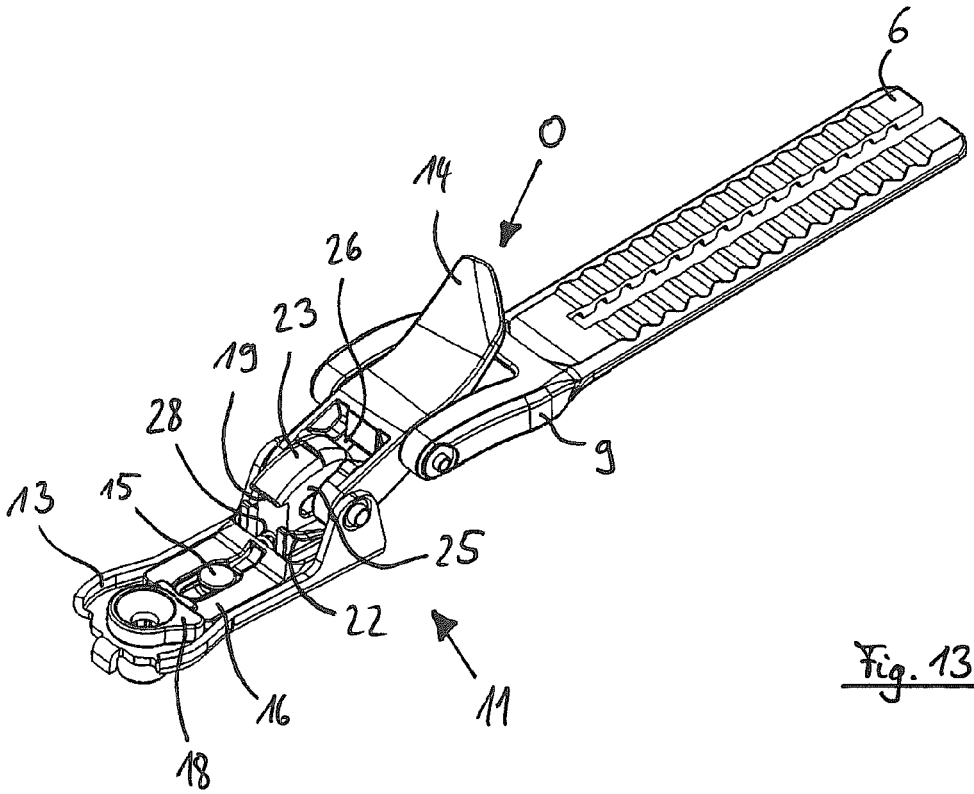
Figure 14:
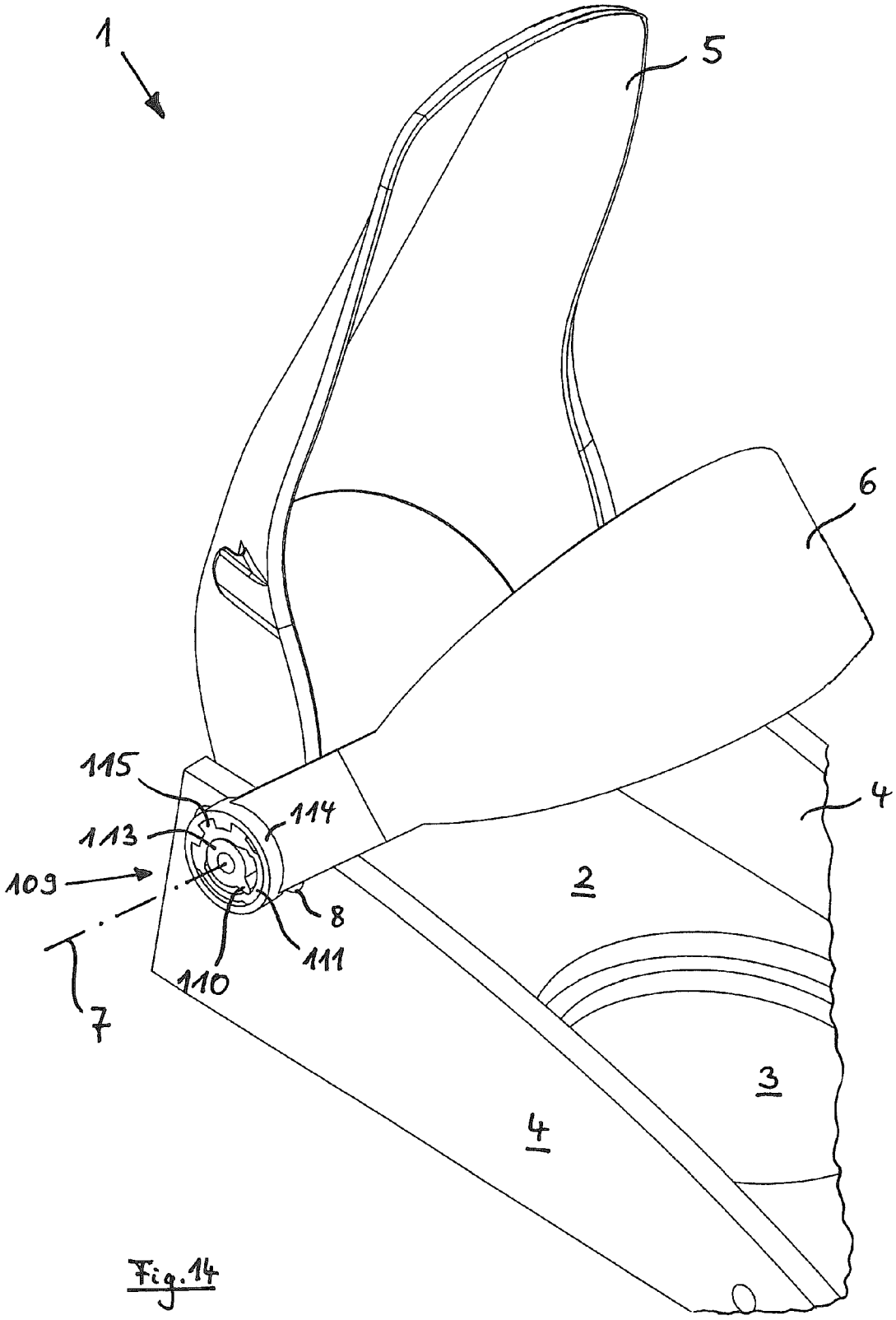
Figure 19:
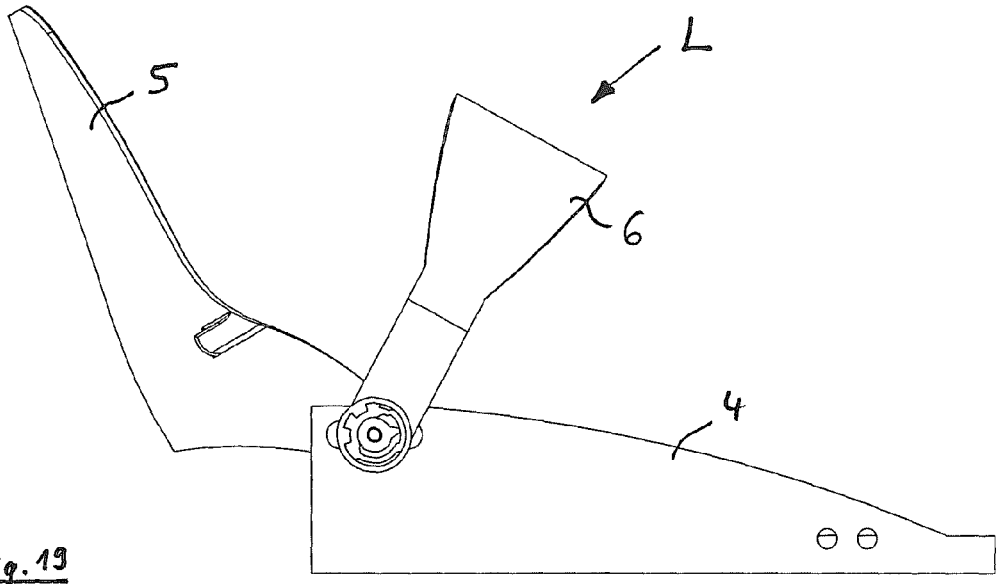
Figure 20:
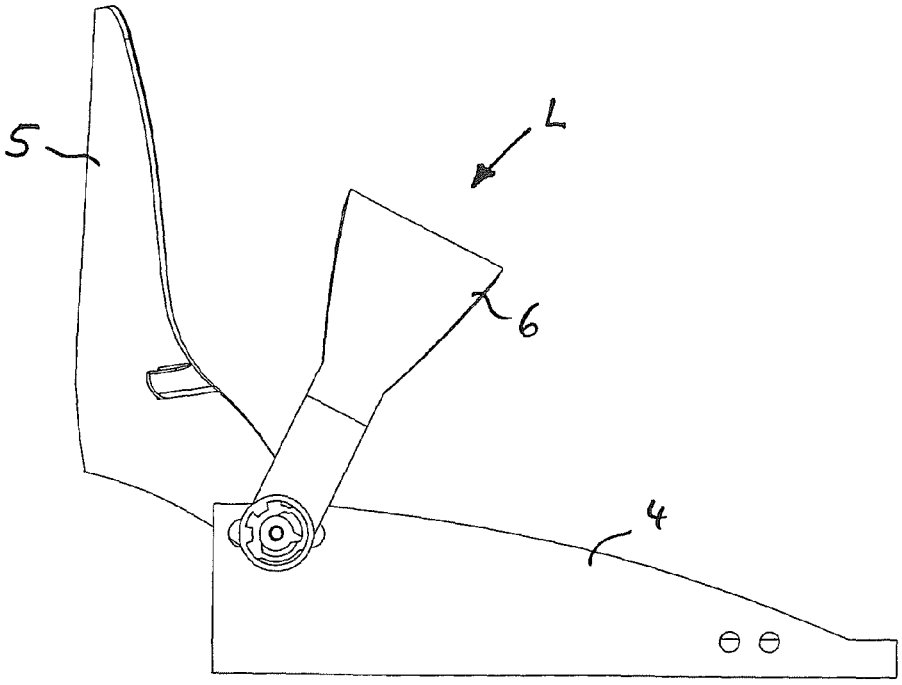
Figure 27:
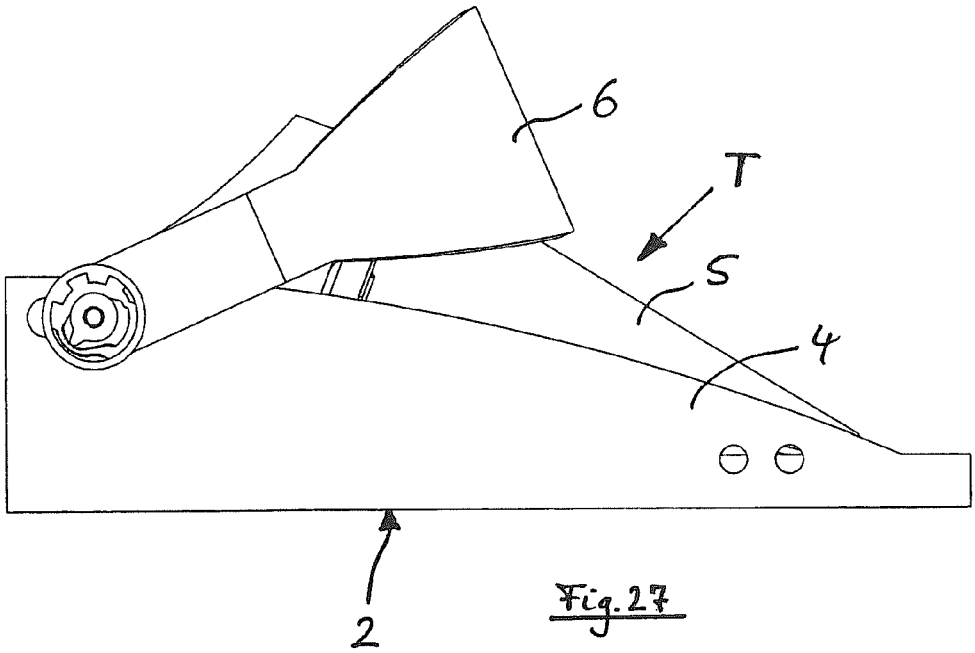
Figure 28:
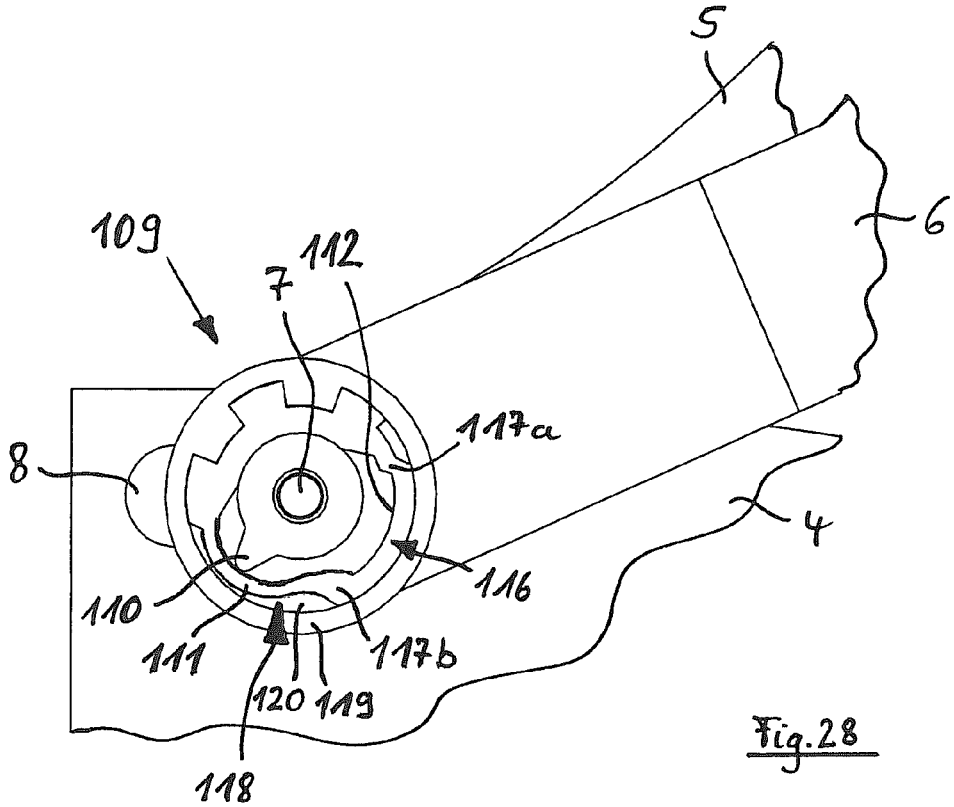
Figure 29:
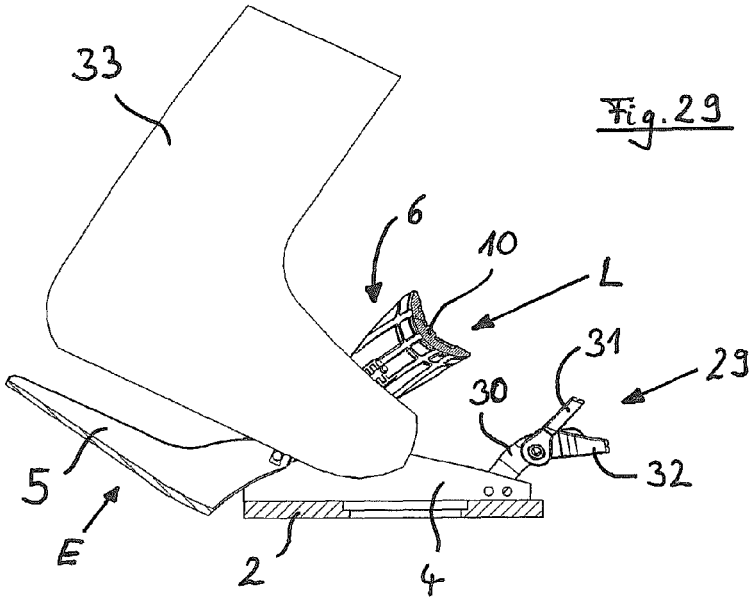
Figure 30:
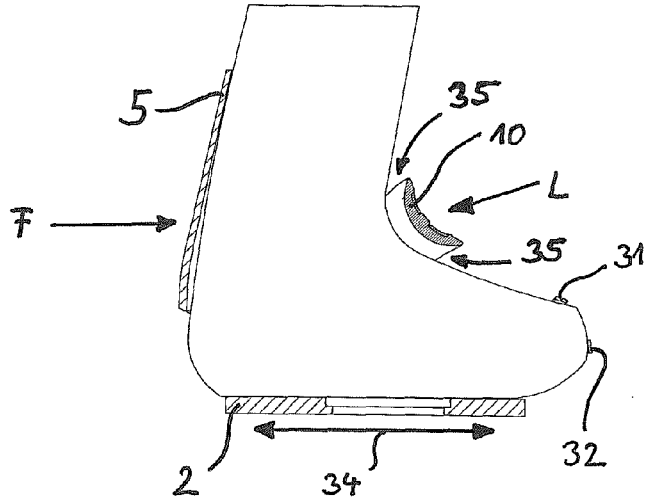
Figure 31:
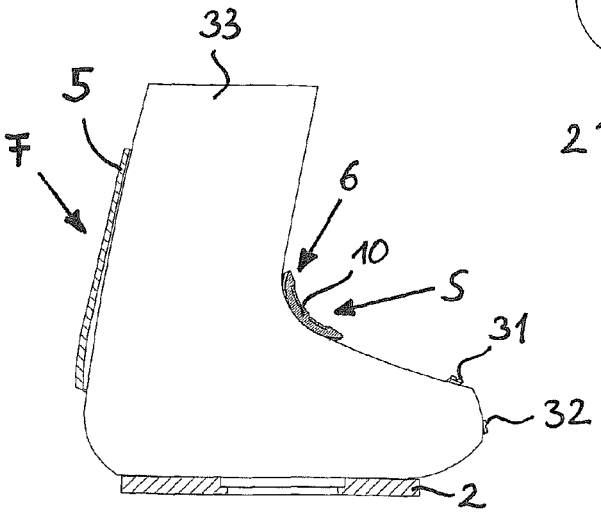

FIG. 13: three-dimensional view of the buckle from FIG. 11 in an opened state;

FIG. 14: a three-dimensional sectional view of an alternative form of implementation of a snowboard binding according to the invention;

FIGS. 15 to 18: Schematic side views of the binding from FIG. 14 while pivoting down the leg support from the travelling position to the entry position;

FIGS. 19 and 20: Schematic side views of the binding from FIG. 14 while pivoting up the leg support from the entry position to the travelling position;

FIGS. 21 to 26: enlarged sectional views of the shared pivoting axis and the control means in the positions of FIGS. 15 to 20;

FIG. 27: schematic side view of the binding from FIG. 14 with a leg support folded down into a transport position;

FIG. 28: enlarged sectional view of the shared pivoting axis and the control means in the travelling positions from FIG. 27; and FIGS. 29 to 31: schematic representation showing the positioning and fastening of a boot with another variant of a snowboard binding according to the invention.

The snowboard binding 1 shown in FIGS. 1 to 3 has a sole-plate 2 with a central, circular opening 3, which can carry a hold-down device in a known manner for fastening on a snowboard. Along each of the two longitudinal sides of the sole-plate 2, there is a side wall 4 shape matched to the sole-plate 2 such that it extends up at approximately a right angle, a snowboard boot can be accommodated and fixed in place in the snowboard binding 1 between these two longitudinal sides.

A leg support 5 and an instep element 6 are pivotably coupled in the back upper area of the side walls. In the example of implementation shown, only one shared pivoting axis 7 has been provided that enables both the leg support 5 and the instep element 6 to pivot. This pivoting axis 7 runs parallel to the sole-plate 2 and at a right angle to the two side walls 4.

To adjust the snowboard binding 1 to different boot sizes, the shared pivoting axis 7 is mounted in one of several drill holes 8, which are allocated along a row running parallel to the sole-plate 2.

With alternative forms of implementation, it is generally also possible to allocate the instep element 6 and/or the leg support 5 directly on the sole-plate 2 or on one of the other elements connected to the sole-plate 2.

In the example of implementation shown, the instep element 6 is essentially formed by means of a continuous strap 9, which is expanded in its intermediate area expanding in a U shape by a pad 10. The strap 9 can be pivoted on a first end along one of the two side walls 4 while its other end is connected with a buckle 11, which is in turn coupled pivotably to the other side wall 4.

The leg support 5 can be pivoted from the front travelling position F shown in FIG. 1 in order to enable easy entry backwards into the entry position E shown in FIG. 2. In order to design the release from the snowboard binding 1 and entry into the snowboard binding 1 even more conveniently, the instep element 6 can also be broadened from the clamping position S shown in FIG. 1 by means of opening the buckle 11 into a release position, which is shown in FIG. 2. Stepping into the snowboard binding 1 is particularly easy due to the lack of frictional forces along the broadened instep element 6.

Thereby, control means 12 are provided, which couple a pivoting movement of the leg support 5 back into the entry position E to an adjustment movement and/or control movement of the instep element 6 for certain sections of the pivoting movement, which causes the buckle 11 to automatically open. During the forward pivoting movement of the leg support 5 into the travelling position F, no coupling to an automatic adjustment of the instep element 6 occurs according to the invention. The buckle 11 is then closed separately by hand when the leg support 5 has been folded up (FIGS. 5 to 7*b*). The coupling is therefore controlled such that it only occurs on the one hand when the leg support 5 is opened and on the other, also thereby only for a portion of the entire pivoting movement of the leg support 5, that is in sections thereof (FIGS. 8 to 10*b*).

The buckle 11 comprises a buckle base 13 and a clamping lever 14 that is pivotably coupled to it as well as a control slider 16 that can be slid in a longitudinal direction on the buckle base 13 guided by two guide bolts 15. The buckle base 13 is pivotably coupled to the side wall 4 and the belt 9 of the instep element 6 is coupled to the clamping lever 14 via a pinion 17.

The control means 12 comprise an actuating cam 18 on the side wall 4, which buckle 11 is coupled to, which is rotationally connected to the leg support 5. This actuating cam 18 can act together with the control slider 16 when twisted, that is during a pivoting movement of the leg support 5. The rounded tip of the actuating cam 18 is up against the control slider 16 at least when certain angularities are present. The actuating cam 18 and the control slider 16 collectively form the inventive control means 12.

Figures 7, 7A, 7B:
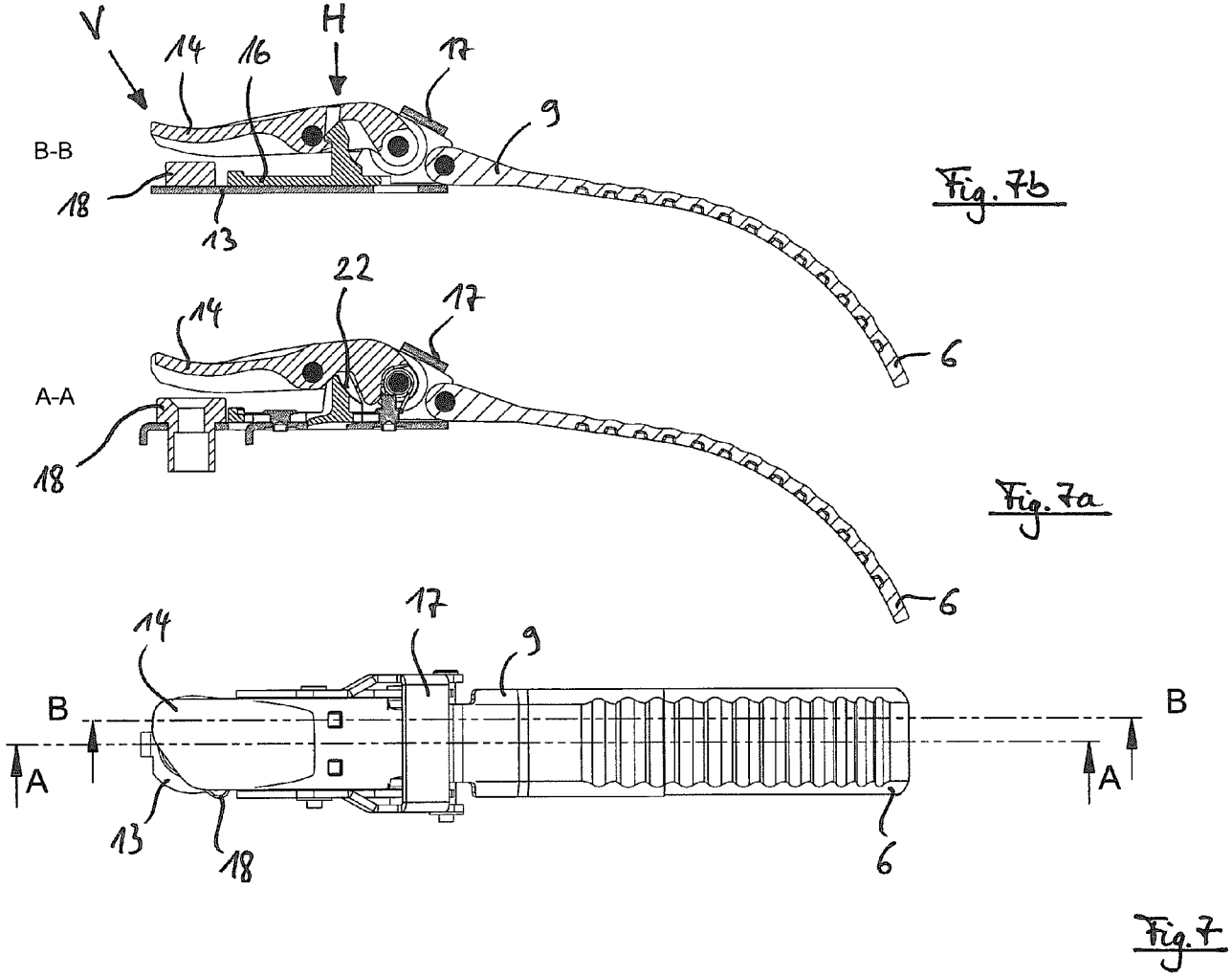
Figure 8:
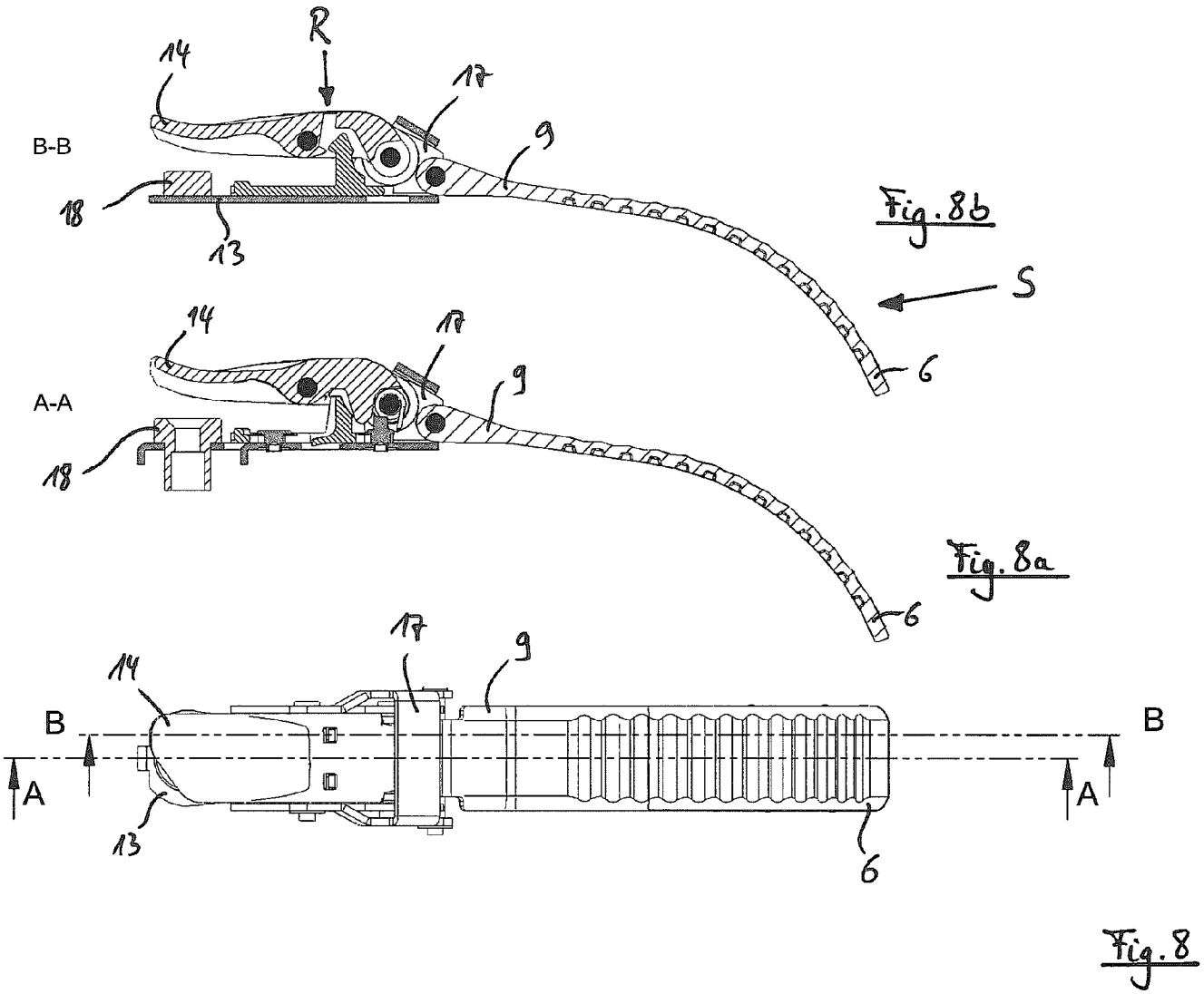
Figures 9, 9A, 9B:
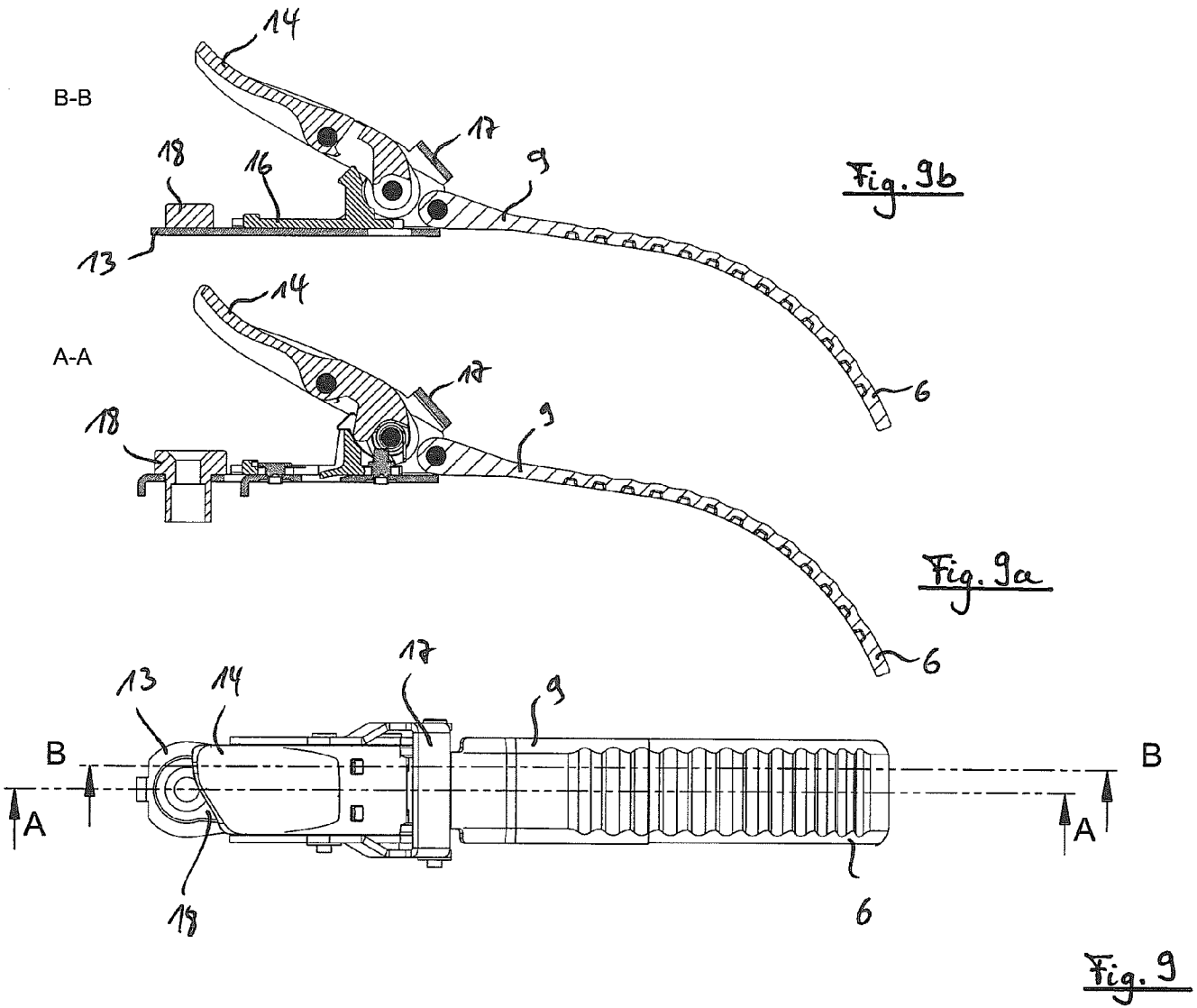
Figures 10, 10A, 10B:
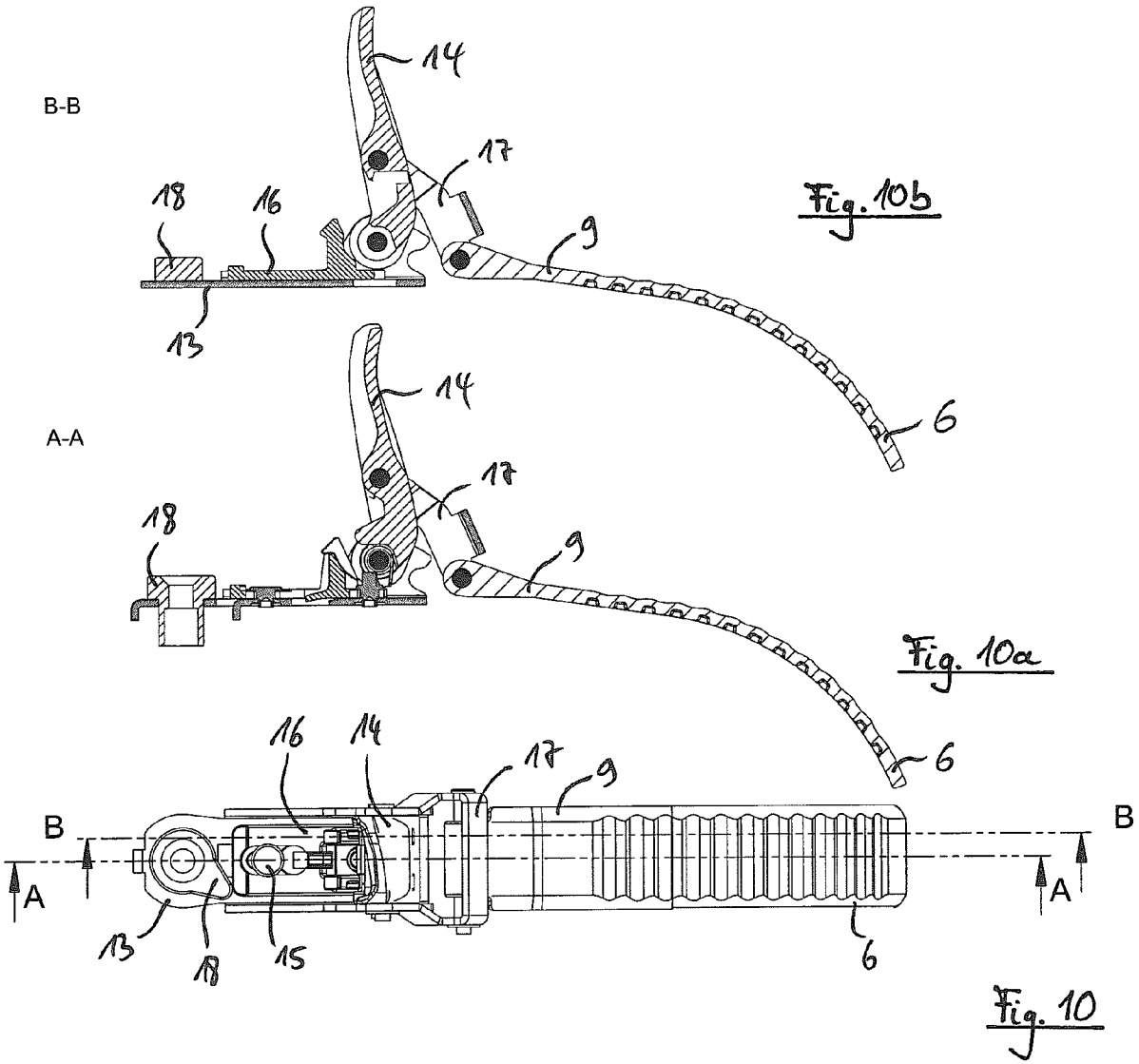

The control slider 16 has two retaining lugs 19, by means of which, when the buckle 11 is closed in a retaining position H of the control slider 16, a lug 20 shaped to the underside of the clamping lever 14 can be embraced such that the clamping lever 14 is held form-fit in its closed position V (FIG. 7*b*). By means of sliding the control slider 16 into a release position R, the form-fit embrace and the resulting clamping of the clamping lever 14 can be released such that the buckle 11 can be opened and the instep element 6 can be enlarged and/or expanded in its area (FIG. 8*b*). Such sliding of the control slider 16 into its release position R can occur either automatically by means of the actuating cam 18 or manually, independent of the pivoting of the leg support 5. Two leg springs 21 are provided for this, by means of which the control slider 16 is spring loaded toward the actuating cam 18.

In order to facilitate the automatic opening of the buckle 11 when pivoting the leg support 5 back, two form-fitting lead-out means in the form of lead-out ramps 22 are created at the control slider 16, by means of which the clamping lever 14 is led out when sliding the control slider 16 and the associated release of the clamping lever 14 for opening the buckle 11 from its closed position V (FIG. 9*a*) is led to the outside.

Furthermore, the control slider 16 has two form-fitting run-in means in the form of run-in bevels 23, which act together when closing the buckle 11 within part 24 of the clamping lever 14 such (FIG. 6*b*) that the control slider 16 is first slid into its release position R up against the springs 21 and then returns to its retaining position H as the buckle 11 is closed further, thereby retaining the clamping lever 14 form-fit in the closed position V (FIG. 7*b*).

When sliding the pivoting axis 7 longitudinally in order to adjust the size of the snowboard binding 1, the control means 12 are automatically taken along by means of insertion into another drill hole 8 and the instep element 6 is always situated at the same distance relative to the leg support 5 such that a separate setting is not necessary.

In FIGS. 11 to 13, a particularly stable and robust variant of an inventive buckle 11 is shown, which not only ensures particularly secure hold of the buckle 11, but is also particularly easy to open by hand separate from the leg support. The essential difference is up to that both the retaining lug 19 and the run-in bevel and/or run-in curve 23 are formed along a massy central bar 25, which is formed integrally with the control slider 16. The clamping lever 14 has an intermediate opening 26 for this, through which the bar 25 can extend through in order to embrace the upper edge of the side wall 27 bordering the opening 26 with its retaining lug 19. This area of the bar 25 extending through the opening 26 is particularly easy to reach by hand and can easily be shifted by hand in order to open the buckle 11.

Here, the control slider 16 is spring loaded by a central helical compression spring 28 toward the actuating cam 18. Furthermore here the belt 9 of the instep element 6 is not coupled via an intermediate element, instead coupling occurs directly or indirectly to the clamping lever 14.

With the variant of an inventive snowboard binding 1 shown in FIGS. 14 to 28, the instep element 6 is also subject to a pivoting movement, which can be coupled, at least in sections, with the leg support 5 in one or in both pivoting directions while on the other hand the opening the buckle 11 is only coupled to the backward pivoting movement of the leg support 5 to the entry position E according to the invention. Thereby, the control means 109 shown in the FIGS. 14 to 28 can be preferably allocated at the end of the instep element 6, which is across from that end of the instep element 6, which the buckle 11 with the respective control means 12 is allocated to.

The leg support 5 can be pivoted out of the front travelling position F back into an entry position E shown in FIG. 14 in order to enable easy entry as previously described. In order to design the entry in the snowboard binding 1 to be even more convenient, the instep element 6 can also be pivoted up to a release position L in this case from the clamping position S shown in FIG. 14. Control means 109 have been provided for this, which couple a pivoting movement of the leg support 5 to a pivoting movement of the instep element 6 across certain sections. Such coupling is therefore controlled in that it does not occur across the entire pivoting range of the support leg 5, but only in part of the pivoting range, that is in sections.

The control means 109 comprise a actuating cam 110 on one or the two side walls 4, which is rotationally connected with the support leg 5 and a control curve 112 formed in a control ring 111 on one or both of the side walls 4. The control ring 111 and as a result, also the control curve 112 are connected in a torque-proof manner with the instep element 6. For the purpose of simplification, only the control means 109 on one side wall 4 are considered in the following description.

The actuating cam 110 is encircled by the control ring 111. Both the actuating cam 110 and the control ring 111 and/or the control curve 112 are mounted on the shared pivoting axis 7 and/or centered on it. In the event of longitudinal shifting of the pivoting axis 7 in order to adjust the size of the snowboard binding 1, the control means 109 are also automatically taken along and the instep element 6 is always situated at the same distance relative to the leg support 5 such that separate adjustment is not necessary.

The actuating cam 110 is allocated on a support connected in a torque-proof manner with the bottom part of the leg support 5 and which protrudes to the outside socket 113, while the control curve 112 is carried in a recess provided in the bottom area of the instep element 6, which is formed in a central area 114 that protrudes in the shape of a pot and which is connected in a torque-proof manner to the instep element 6. The control ring 111 made of a hard rubber mixture with the control curve 112 exhibits multiple arms 115 protruding radially to the outside and which are carried form-fit in the complementary retracted parts of the central area 114.

The control curve 112 comprises a free-movement area 116, which extends across an angle of approximately. 60° between the two stops 117*a* and 117*b*. The actuating cam 110 can move freely across this free-movement area 116 without taking along the control curve 112 and consequently the instep element 6 thereby. A transport area 118 connects to the free-movement area 116 behind the second stop 117*b*. In this transport area 118, a radial free area 120 is formed between the control curve 112 and the wall 119 bordering the recess in the central area. The transport area 118 of the control curve 112 can be elastically pressed into this free area 120 by the actuating cam 110 if it has overcome the stop 117*b* (FIG. 28). This elastically deformable transport area 118 thereby serves to prevent the control curve 112 from being destroyed when the support leg 5 is folded all the way to the front and into a transport position T (FIG. 27) onto the sole-plate 2 of the binding 1 or on the surface of the snowboard, which can be performed in order to store the snowboard or when transporting it. Thereby the actuating cam 110 indeed has to overcome increased resistance once it has reached the stop 117*b*, but it can then be moved further across the transport area 118 with slightly more effect.

Figure 15:
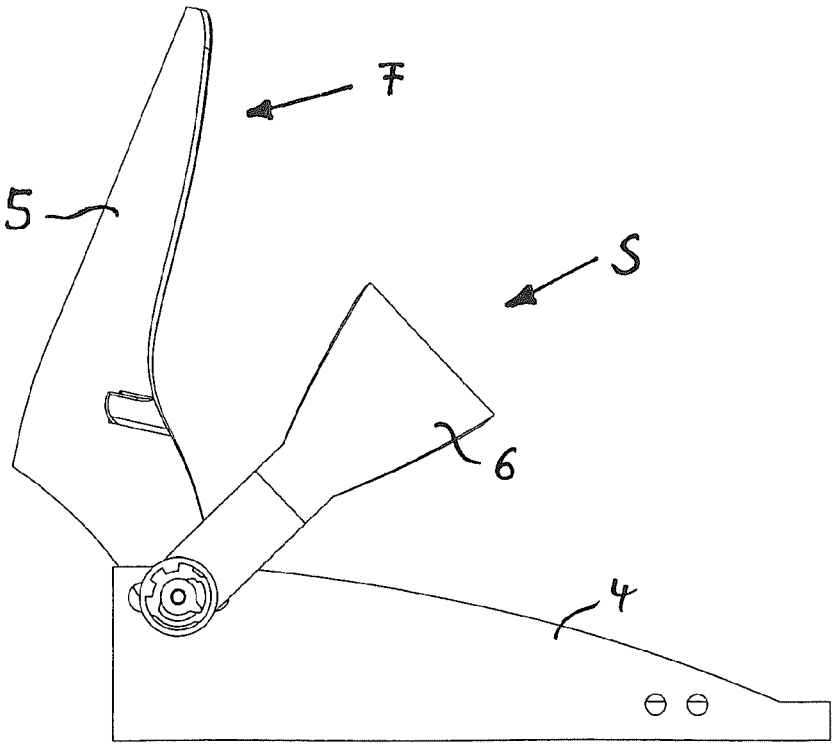
Figure 16:
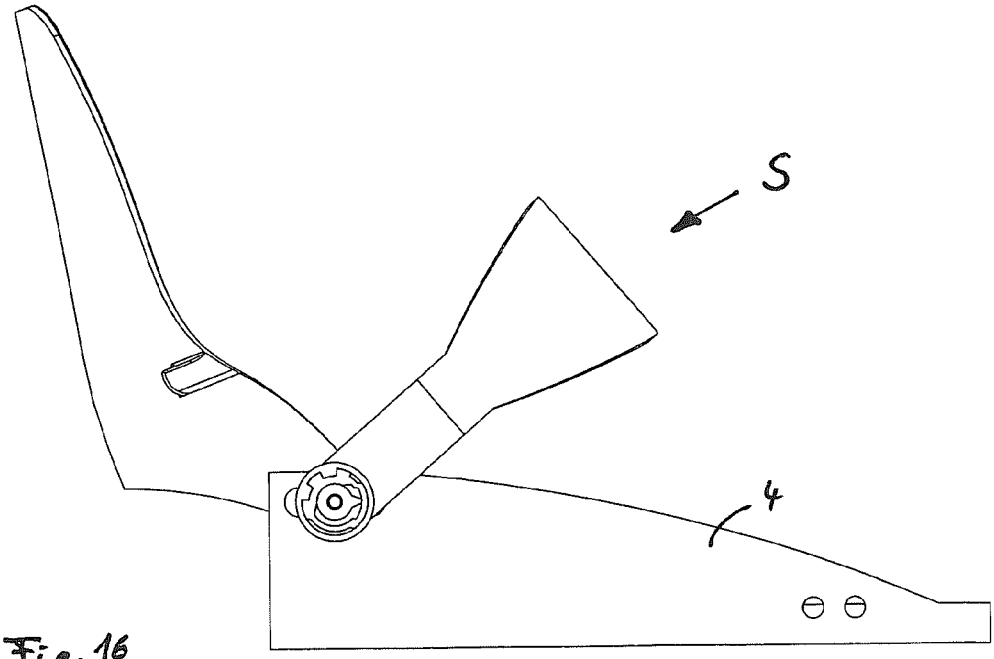
Figure 17:
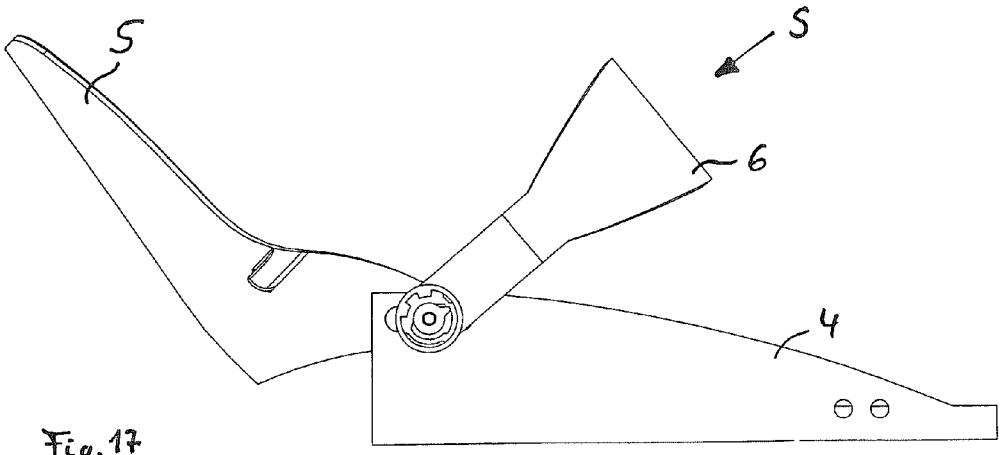
Figure 18:
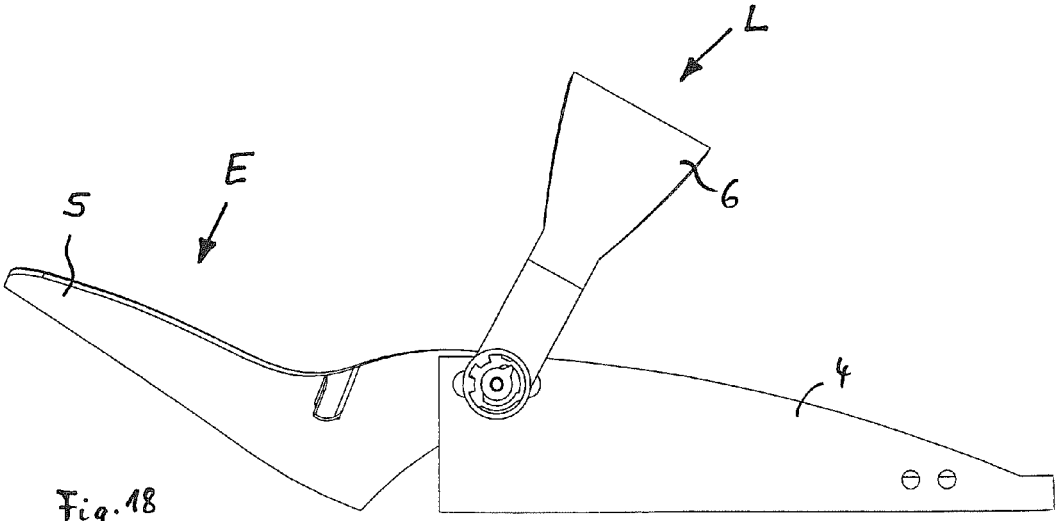
Figure 21:
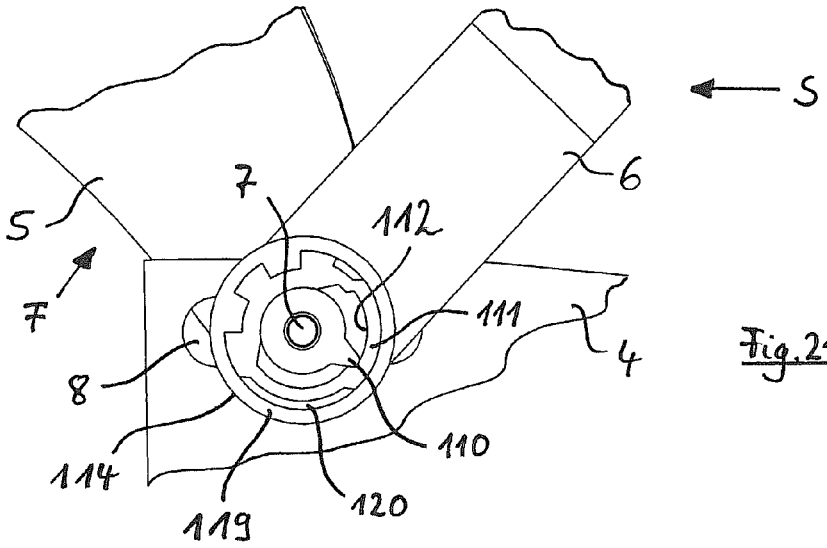
Figure 22:
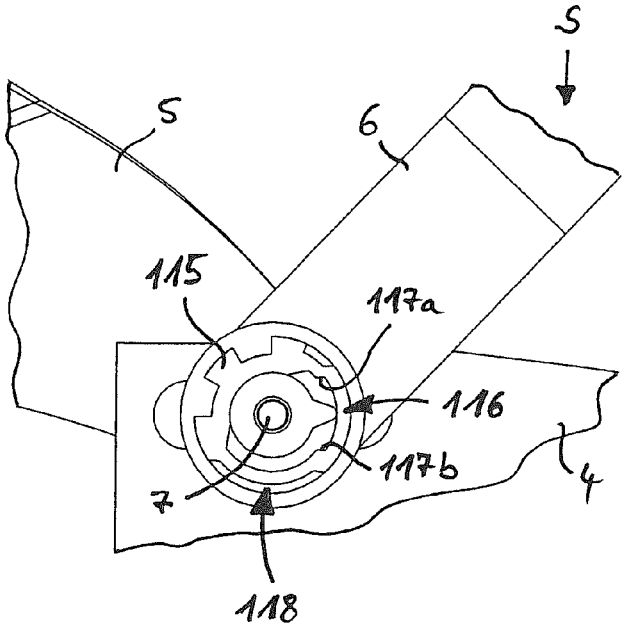
Figure 23:
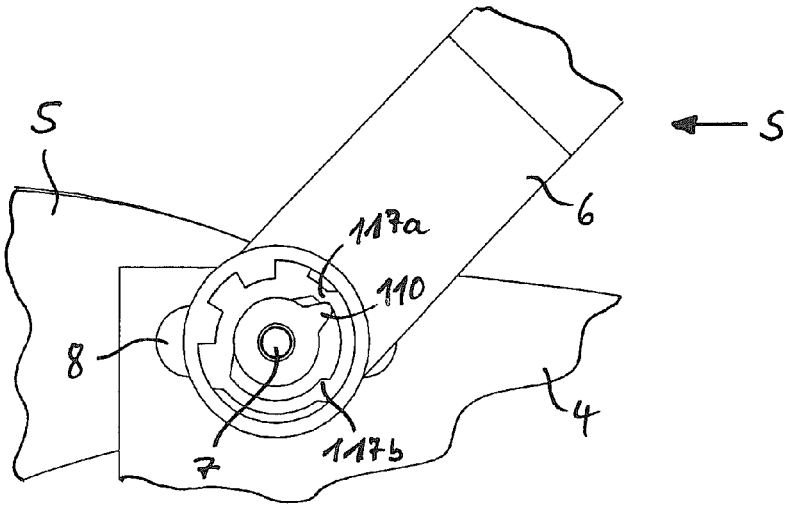
Figure 24:
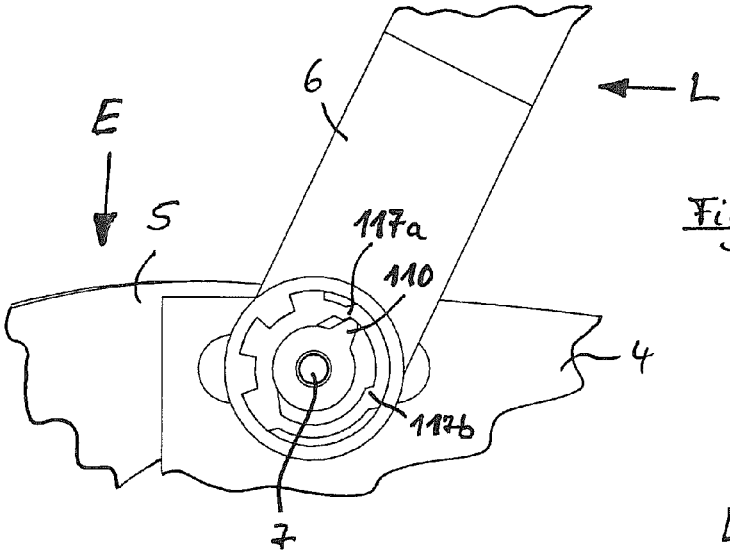
Figure 25:
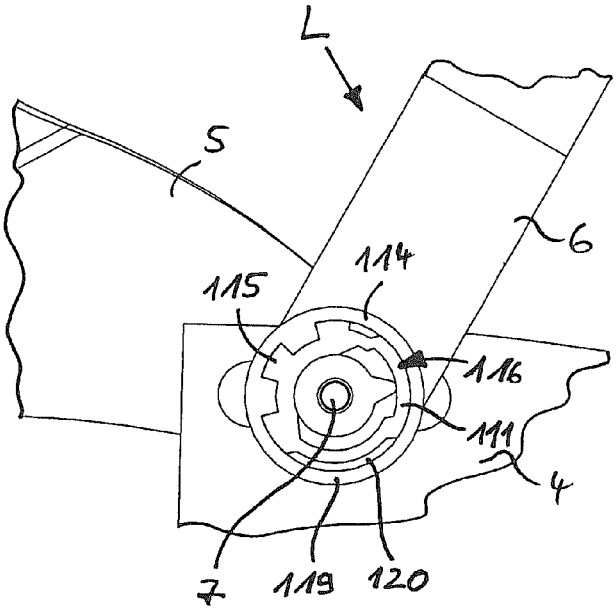
Figure 26:
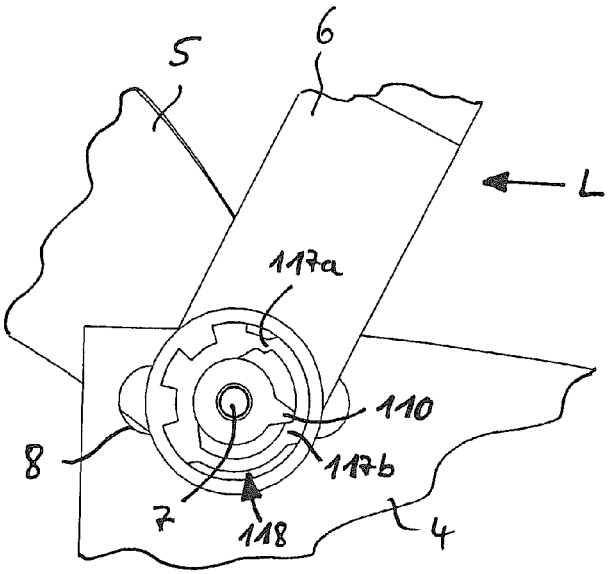

The function of this variant of an inventive snowboard binding 1 is described below:

With the closed positions of the snowboard binding 1 shown in FIGS. 15 and 21, the leg support 5 is located in the travelling position F and the instep element 6 in the clamping position S. In this position, the leg support 5 is fixed by locking means not shown here. After the locking means, which preferably comprise a cable pull, are released, the leg support 5 can be folded back into the entry position E from the travelling position F, which is shown in FIGS. 18 and 24. Thereby, the actuating cam 110, which is rotationally connected with the leg support 5, first moves freely across the free-movement area 116 such that the instep element 6 still remains in its clamping position S (FIGS. 16 and 22).

Only at a certain distance before completing the opening movement, does the actuating cam 110 come into contact with the stop 117*a* (FIGS. 17 and 23) such that the control curve 112 is now taken along by the actuating cam 110 as the leg support 5 is pivoted further to continue opening the binding 1 thereby also pivoting the instep element 6 up. Thereby, the instep element 6 is pivoted into an upper release position L such that a particularly large amount of space is available for entry into and/or release from the snowboard binding 1. Both entry and release is therefore designed to be very convenient. As already mentioned, the automatic opening of the buckle 11 of the instep element 6 previously described can also occur thereby.

When closing the binding 1, the leg support 5 is pivoting up from the entry position E (FIGS. 18 and 24) back into the travelling position (FIGS. 15 and 21) and again locked in place there. Thereby, the actuating cam 110 first freely moves across the free movement area 116 (FIGS. 19 and 25) in a manner similar to the opening step until it comes into contact with the second stop 117*b* (FIGS. 20 and 26) and takes along the control curve 112 from that point on. Then, with the leg support 5 folded all the way up into the final travelling position F, the instep element 6 is again pivoted to the front until it has reached its designated clamping position S (FIGS. 15 and 21) with the binding closing in terms of pivotability. In this clamping position S, the instep element 6 is kept form-fit across the control curve 112 and the actuating cam 110 with a locked leg support 5 and pushed against a snowboard boot accommodated in the snowboard binding 1, at least after one buckle 11 has been closed.

The form of implementation of an inventive snowboard binding 1 shown in FIGS. 29 to 31 also has, in addition to the instep element 6, a toe element 29 in the front area of the binding 1, which is preferably pivotable across a brace 30 on the side walls 4. By means of this toe element 29, which has an upper strap 31 and a front strap 32, the front area of a boot 33 accommodated in the binding 1 can be embraced both from the front and from above (FIG. 29). In this way, the boot 33 is held in place facing forward by the toe element 29 and/or by the front strap 32.

If the leg support 5 is locked in the front travelling position F, a boot 33 accommodated in the snowboard binding 1 is fixed in place by the leg support 5 and the toe element 29 in its longitudinal direction 34 relative to the snowboard binding 1 and also simultaneously clamped between the leg support 5 and the toe element 29. Thereby, pivoting the leg support 5 forward into the front travelling position F affects the positioning and clamping of the boot 33 in a longitudinal direction 34. The instep element 6 does not act in fixing the boot 33 in place. Fixing and/or clamping the boot 33 in place in a longitudinal direction 34 is already possible when the instep element 6 is still open. For this, a distance 35 between the boot 33 and the pad 10 of the instep element 6 in its release position L is apparent in FIG. 30.

Only after the longitudinal positioning of the boot 33 has occurred, is the instep element 6 brought into its clamping position S by means of closing the buckle 11. Only after this has occurred, is the boot 33 is finally fixed in place with this form of implementation of the snowboard binding 1 (FIG. 31).

Although the present invention was described here solely using the preferred examples of implementation shown in the Figures, it is not restricted to such examples, but can be modified in a variety of different ways. In particular, the adjustment movement of the instep element 6 is not restricted to the automatic opening of the buckle 11, but this can concern any movements for changing the instep element 6, which also preferably serve to enable particularly convenient release from the binding 1 and/or entry into the binding 1. For example, the inventively controlled adjustment movement of the instep element 6 can also be restricted to a pivoting movement as described in FIGS. 14 to 28.

Furthermore, with corresponding adjustment of the control means, the instep element 6 can also be made of two half straps, which can be opened and/or closed by means of a buckle allocated in the middle between the two half straps.

| | |
|---|---|
| 1 | Snowboard binding |
| 2 | Sole-plate |
| 3 | Central opening |
| 4 | Side wall |
| 5 | Leg support |
| 6 | Instep element |
| 7 | Pivoting axis |
| 8 | Bore holes |
| 9 | Strap |
| 10 | Pad |
| 11 | Buckle |
| 12 | Control means |
| 13 | Buckle base |
| 14 | Clamping lever |
| 15 | Two guide bolts |
| 16 | Control slider |
| 17 | Pinion |
| 18 | Actuating cam |
| 19 | Retaining lugs |
| 20 | Lug |
| 21 | Leg springs |
| 22 | Lead-out ramps |
| 23 | Run-in bevels |
| 24 | Area of the clamping lever |
| 25 | Intermediate bar |
| 26 | Intermediate opening |
| 27 | Side wall |
| 28 | Helical compression spring |
| 29 | Toe element |
| 30 | Brace |
| 31 | Upper strap |
| 32 | Front strap |
| 33 | Boot |
| 34 | Longitudinal direction |
| 35 | Distance |
| 109 | Control means |
| 110 | Actuating cam |
| 111 | Control ring |
| 112 | Control curve |
| 113 | Socket |
| 114 | Central area |
| 115 | Arms |
| 116 | Free-movement area |
| 117a, 117b | Stops |
| 118 | Transport area |
| 119 | Wall |
| 120 | Radial free area |
| S | Clamping position instep element |
| L | Release position instep element |
| E | Entry position leg support |
| F | Travelling position leg support |

-continued

| | |
|---|---|
| T | Transport position leg support |
| H | Retaining position control slider |
| R | Release position control slider |
| V | Closing position clamping lever |
| O | Opening position clamping lever |

The invention claimed is:

1. A snowboard binding with a sole-plate (2), which is capable of being fastened on the surface of a snowboard and to which an instep element (6) is fastened or coupled, which can be adjusted between a clamping position (S) and a release position (L) and by which the upper side of a boot, which can be accommodated in the snowboard binding (1), can be partially embraced, and to which a leg support (5) is pivotably coupled, which leg support can be pivoted between a rear entry position (E) and a front travelling position (F), wherein controllers (12, 109) are provided by means of which a pivoting movement of the leg support (5) into the entry position (E) is coupled at least in some sections to an adjustment movement of the instep element (6) from the clamping position (S) into the release position (L), wherein the controllers (12, 109) provide that the adjustment movement of the instep element (6) that is brought about during the pivoting of the leg support (5) back into the entry position (E) is greater than the adjustment movement of the instep element (6) that is brought about when pivoting the leg support (5) forward into the travelling position (F), and wherein the instep element (6) comprises at least one buckle (11) that can be manipulated by the controller (12), which brings about the opening or expansion of the instep element (6) when pivoting the leg support (5) back into the entry position (E).

2. A binding according to claim 1, wherein the controllers (12, 109) provide that they only bring about coupling to the adjustment movement of the instep element (6) when pivoting the leg support (5) back into the entry position (E) and that the forward pivoting of the leg support (5) to the travelling position (F) is not coupled to an adjustment movement of the instep element (6).

3. A binding according to claim 1, wherein the adjustment movement of the instep element (6) comprises a pivoting movement and/or opening movement.

4. A binding according to claim 1 wherein the controller (12) comprise at least one actuating cam (18), which is rotationally connected to the leg support (5), wherein the actuating cam (18) acts at least in sections directly or indirectly with a mobile element belonging to the buckle (11) of the instep element (6).

5. A binding according to claim 4 wherein the instep element (6) comprises a buckle (11) with a buckle base (13) coupled to the sole-plate (2) and a pivotable clamping lever (14) mounted on it as well as a strap (9) coupled directly or coupled via a pinion (17) to the clamping lever (14), wherein a control slider (16) that can be slid is routed in the buckle base (13), which the actuating cam (18) acts together with.

6. A binding according to claim 5 wherein at least one spring element (21, 28) is provided that spring loads the control slider (16) toward the actuating cam (18).

7. A binding according to claim 5 wherein the control slider (16) has at least a retaining lug (19), which embraces a lug (20) or an edge of the clamping lever (14) form-fit when the buckle (11) is closed in a retaining position (H) of the control slider (16) and keeps the clamping lever (14) in a closed position (V), wherein the form-fit embrace can be released by sliding the control slider (16) to a release position (R).

8. A binding according to claim 7, wherein the control slider (16) can be shifted into the release position (R) during the pivoting of the support leg (5) to the rear entry position (E) by the actuating cam (18).

9. A binding according to claim 7 wherein the control slider (16) has at least one form-fitting lead-out and/or lead-out curve, by which, with the shifting of the control slider (16) from its retaining position (H) toward its release position (R), the strap (9) of the instep element (6) can be led out of its clamping position (S) and/or the clamping lever (14) can be led out of its closed position (V).

10. A binding according to claim 5 wherein the clamping lever (14) of the buckle (11) is spring loaded toward an opening position (O) by a spring element.

11. A binding according to claim 7 wherein at least one spring element (21, 28) is provided that spring loads the control slider (16) toward the actuating cam (18) and wherein the control slider (16) has at least one form fitting run-in and/or run-in curve, which act together when closing the buckle (11) with part of the clamping lever (14) such that the control slider (16) can at least be slid up to its release position (R) against the spring element (21, 28), wherein while continuing to close the buckle (11), the control slider (16) returns to the retaining position (H) and holds the clamping lever (14) in its closing position (V).

12. A binding according to claim 1 wherein the pivoting axis (7) of the instep element (6) is identical to the pivoting axis (7) of the leg support (5).

13. A binding according to claim 12 wherein the shared pivoting axis (7) of the instep element (6) and the leg support (5) is adjustably allocated on the sole-plate (2).

14. A binding according to claim 1 wherein the controllers comprise at least one lever and/or at least one pusher and/or at least one puller.

15. A binding according to claim 1 wherein the controllers comprise at least one gear.

16. A binding according to claim 1 wherein the controllers (12, 109) comprise at least one actuating cam (110), which is rotationally connected with one of the two elements instep element (6) or leg support (5), wherein the actuating cam (110) acts together with a control curve (112), which is connected in a torque-proof manner to the other of the two elements leg support (5) or instep element (6) such that pivoting of the leg support (5) is also coupled to pivoting of the instep element (6), at least in sections.

17. A binding according to claim 16 wherein the control curve (112) is within a control ring (111), which encircles the actuating cam (110) and which is inserted in a torque-proof manner in a recess formed on the other of the two elements leg support (5) or instep element (6).

18. A binding according to claim 17 wherein that the control curve (112) comprises a free-movement area (116) limited by two stops (117*a*, 117*b*), wherein the actuating cam (110) can be freely pivoted across the free movement area (116) between the two stops (117*a*, 117*b*).

19. A binding according to claim 18 the control curve (112) can be deformed elastically in the vicinity of the stop (117*b*) and/or in a transport area (118) adjacent to the free movement area (116).

20. A binding according to claim 19 the control ring (111) consists of an elastic material at least in the transport area (118) and that a radial free area (120) is formed, at least in sections, in the transport area (118) between the control ring (111) and the wall (119) of the recess.

21. A binding according to claim 16, the actuating cam (110) is connected in a torque-proof manner with the leg support (5) and that the control curve (112) is connected in a torque-proof manner with the instep element (6).

22. A binding according to claim 1 the buckle (11) can be unhinged at least in an intermediate position such that the instep element (6) can be separated into two partial elements that are separated from one another and which are fastened or coupled to the sole-plate (2) with an area removed from the buckle (11).

23. A snowboard, comprising two bindings (1) according to claim 1.

24. A binding according to claim 1 wherein the controller (12) comprise at least one actuating cam (18), which is rotationally connected to the leg support (5), wherein the actuating cam (18) acts at least in sections directly or indirectly with a mobile element belonging to the buckle (11) of the instep element (6), and the instep element (6) comprises a buckle (11) with a buckle base (13) pivotably coupled to the sole-plate (2) and a pivotable clamping lever (14) mounted on it as well as a strap (9) coupled directly or coupled via a pinion (17) to the clamping lever (14), wherein a control slider (16) that can be slid is routed in the buckle base (13), which the actuating cam (18) acts together with;

or the control slider (16) can be shifted into the release position (R) during the pivoting of the support leg (5) to the rear entry position (E) by the actuating cam (18), and the control slider (16) has at least one lead-out ramp (22) and/or lead-out curve, by which, with the shifting of the control slider (16) from its retaining position (H) toward its release position (R), the strap (9) of the instep element (6) can be led out of its clamping position (S) and/or the clamping lever (14) can be led out of its closed position (V);

or the controller (12) comprise at least one actuating cam (18), which is rotationally connected to the leg support (5), wherein the actuating cam (18) acts at least in sections directly or indirectly with a mobile element belonging to the buckle (11) of the instep element (6), and the instep element (6) comprises a buckle (11) with a buckle base (13) coupled to the sole-plate (2) and a pivotable clamping lever (14) mounted on it as well as a strap (9) coupled directly or coupled via a pinion (17) to the clamping lever (14), wherein a control slider (16) that can be slid is routed in the buckle base (13), which the actuating cam (18) acts together with, and the control slider (16) has at least a retaining lug (19), which embraces a lug (20) or an edge of the clamping lever (14) form-fit when the buckle (11) is closed in a retaining position (H) of the control slider (16) and keeps the clamping lever (14) in a closed position (V), wherein the form-fit embrace can be released by sliding the control slider (16) to a release position (R), and at least one spring element (21, 28) is provided that spring loads the control slider (16) toward the actuating cam (18), and the control slider (16) has at least one run-in bevel (23) and/or run-in curve, which act together when closing the buckle (11) with part of the clamping lever (14) such that the control slider (16) can at least be slid up to its release position (R) against the spring element (21, 28), wherein while continuing to close the buckle (11), the control slider (16) returns to the retaining position (H) and holds the clamping lever (14) in its closing position (V);

or the pivoting axis (7) of the instep element (6) is identical to the pivoting axis (7) of the leg support (5), and the shared pivoting axis (7) of the instep element (6) and the leg support (5) is adjustably allocated on the sole-plate (2) on two side walls (4) protruding up on both sides of the base plate (2) along the longitudinal direction of the base plate (2);

or the controllers comprise at least one lever and/or at least one pusher and/or at least one cable pull;

or the controllers comprise at least one pinion gear.

* * * * *